US009441319B2

(12) United States Patent
Ihira et al.

(10) Patent No.: US 9,441,319 B2
(45) Date of Patent: Sep. 13, 2016

(54) EMBROIDERY DATA GENERATING DEVICE AND NON-TRANSITORY COMPUTER-READABLE MEDIUM STORING EMBROIDERY DATA GENERATING PROGRAM

(71) Applicant: BROTHER KOGYO KABUSHIKI KAISHA, Nagoya-shi, Aichi-ken (JP)

(72) Inventors: Yuki Ihira, Kakamigahara (JP); Tomotaka Katano, Nagoya (JP); Kenji Yamada, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 14/618,529

(22) Filed: Feb. 10, 2015

(65) Prior Publication Data

US 2015/0240399 A1 Aug. 27, 2015

(30) Foreign Application Priority Data

Feb. 26, 2014 (JP) ..... 2014-034766

(51) Int. Cl.

| | |
|---|---|
| ***D05B 19/12*** | (2006.01) |
| ***D05C 7/00*** | (2006.01) |
| ***D05C 5/00*** | (2006.01) |
| ***D05B 3/00*** | (2006.01) |

(52) U.S. Cl.

CPC ..... *D05B 19/12* (2013.01); *D05B 3/00* (2013.01); *D05C 5/00* (2013.01); *D05C 7/00* (2013.01)

(58) Field of Classification Search

CPC ..... D05C 5/00; D05C 7/00; D05C 17/00; D06Q 1/00; D03D 15/06; D05B 3/00; D05B 3/08; D05B 3/10; D05B 37/00; D05B 37/02; D05B 37/04; D05B 19/12; D05B 81/00; D05B 21/00

See application file for complete search history.

(56) References Cited

U.S. PATENT DOCUMENTS

| | | | | |
|---|---|---|---|---|
| 653,113 | A * | 7/1900 | Noble | D05B 93/00 112/437 |
| 1,201,446 | A * | 10/1916 | De Voe | D05B 93/00 112/426 |
| 1,741,620 | A * | 12/1929 | Fixler | D04B 33/00 112/405 |
| 8,939,096 | B2 * | 1/2015 | Yamanashi | D05B 19/12 112/102.5 |
| 2009/0188413 | A1 * | 7/2009 | Hirata | D05B 19/10 112/103 |

(Continued)

FOREIGN PATENT DOCUMENTS

| | | | |
|---|---|---|---|
| JP | H09217261 | A | 8/1997 |
| WO | 2005087452 | A1 | 9/2005 |

*Primary Examiner* — Ismael Izaguirre
(74) *Attorney, Agent, or Firm* — Oliff PLC

(57) ABSTRACT

An embroidery data generating device has a hole data acquisition portion, an embroidery data acquisition portion, a polygon acquisition portion, a line segment generating portion and a bridge data generating portion. The hole data acquisition portion acquires hole data to form a hole in a sewing workpiece. The embroidery data acquisition portion acquires embroidery data corresponding to an embroidery pattern that is arranged on the inside of the hole. The polygon acquisition portion acquires a minimum polygon that encompasses the embroidery pattern, based on the acquired embroidery data. The line segment generating portion generates a line segment that joins the polygon and a peripheral edge portion of the hole. The bridge data generating portion generates bridge data to form bridge stitches between the embroidery pattern and the peripheral edge portion of the hole, based on the generated line segments.

18 Claims, 25 Drawing Sheets

(56) References Cited

U.S. PATENT DOCUMENTS

2011/0056421 A1* 3/2011 Kawaguchi ..... D05B 19/10
112/470.01

2013/0112129 A1* 5/2013 Muto ..... D05B 81/00
112/470.05

* cited by examiner

EMBROIDERY DATA GENERATING DEVICE AND NON-TRANSITORY COMPUTER-READABLE MEDIUM STORING EMBROIDERY DATA GENERATING PROGRAM

CROSS-REFERENCE TO RELATED APPLICATION

This application claims priority to Japanese Patent Application No. 2014-34766 filed on Feb. 26, 2014, the disclosure of which is herein incorporated by reference in its entirety.

BACKGROUND

The present disclosure relates to an embroidery data generating device and to a non-transitory computer-readable medium storing an embroidery data generating program.

In related art, a sewing machine is known on which a cutting needle is mounted in place of a sewing needle. The cutting needle is a rod-like member that is provided with a sharp cutting edge on its leading end. The sewing machine causes the cutting needle to move up and down by a same operation as when performing sewing, and repeatedly pierces a work cloth with the cutting needle. In this manner, the sewing machine cuts warp threads (vertical threads) and weft threads (horizontal threads) of the work cloth. At the same time, the sewing machine causes an embroidery frame that holds the work cloth to move. By doing this, the sewing machine can form a hole of a specific shape and cuts in the work cloth.

An example of a known pattern generating method will be explained below. Cutter blades (corresponding to cutting needles) are mounted on a plurality of needle bars of a multi-needle sewing machine. After forming a hole in a work cloth, this multi-needle sewing machine performs overcasting on the peripheral edge of the hole. In this pattern generating method, by changing a shape of the hole that is opened in the work cloth and also finishing the hole by overcasting the peripheral edge of the hole, it is possible to form a beautiful pattern hole in a fabric.

SUMMARY

In the above-described known pattern generating method, it is possible to finish the peripheral edge of the hole formed in the work cloth in a beautiful manner, but it is not possible to form an embroidery pattern on the inside of the hole.

Various exemplary embodiments of the general principles described herein provide an embroidery data generating device and a non-transitory computer-readable medium storing an embroidery data generating program, the device and the program being capable of generating embroidery data that can form an embroidery pattern on the inside of a hole formed in a sewing workpiece.

Embodiments herein provide an embroidery data generating device having a hole data acquisition portion, an embroidery data acquisition portion, a polygon acquisition portion, a line segment generating portion and a bridge data generating portion. The hole data acquisition portion is configured to acquire hole data to form a hole in a sewing workpiece. The embroidery data acquisition portion is configured to acquire embroidery data corresponding to an embroidery pattern to be arranged on the inside of the hole. The polygon acquisition portion is configured to acquire a minimum polygon that encompasses the embroidery pattern, based on the acquired embroidery data. The line segment generating portion is configured to generate a line segment that joins the polygon and a peripheral edge portion of the hole. Specifically, the line segment generating portion is configured to generate a plurality of line segments that join the polygon and the peripheral edge portion of the hole by generating the line segment for each of a plurality of different points on the polygon. The bridge data generating portion is configured to generate bridge data to form bridge stitches between the embroidery pattern and the peripheral edge portion of the hole, based on the generated line segments.

Embodiments herein also provide a non-transitory computer-readable medium storing computer-readable instructions. The computer-readable instructions, when executed by a processor of an embroidery data generating device, cause the device to perform processes including: acquiring hole data to form a hole in a sewing workpiece; acquiring embroidery data corresponding to an embroidery pattern to be arranged on the inside of the hole; acquiring, based on the acquired embroidery data, a minimum polygon that encompasses the embroidery pattern; generating a plurality of line segments that join the polygon and a peripheral edge portion of the hole by generating a line segment that joins the polygon and the peripheral edge portion of the hole for each of a plurality of different points on the polygon; and generating, based on the generated line segments, bridge data to form bridge stitches between the embroidery pattern and the peripheral edge portion of the hole.

BRIEF DESCRIPTION OF THE DRAWINGS

Embodiments will be described below in detail with reference to the accompanying drawings in which.

DETAILED DESCRIPTION

Hereinafter, an embodiment will be explained with reference to the drawings. A structure of a multi-needle sewing machine (hereinafter simply referred to as a sewing machine) 1 will be explained with reference to FIG. 1 to FIG. 3. The upper side, the lower side, the lower left side, the upper right side, the upper left side and the lower right side in FIG. 1 respectively denote the upper side, the lower side, the front side, the rear side, the left side and the right side of the sewing machine 1.

Figure 1:
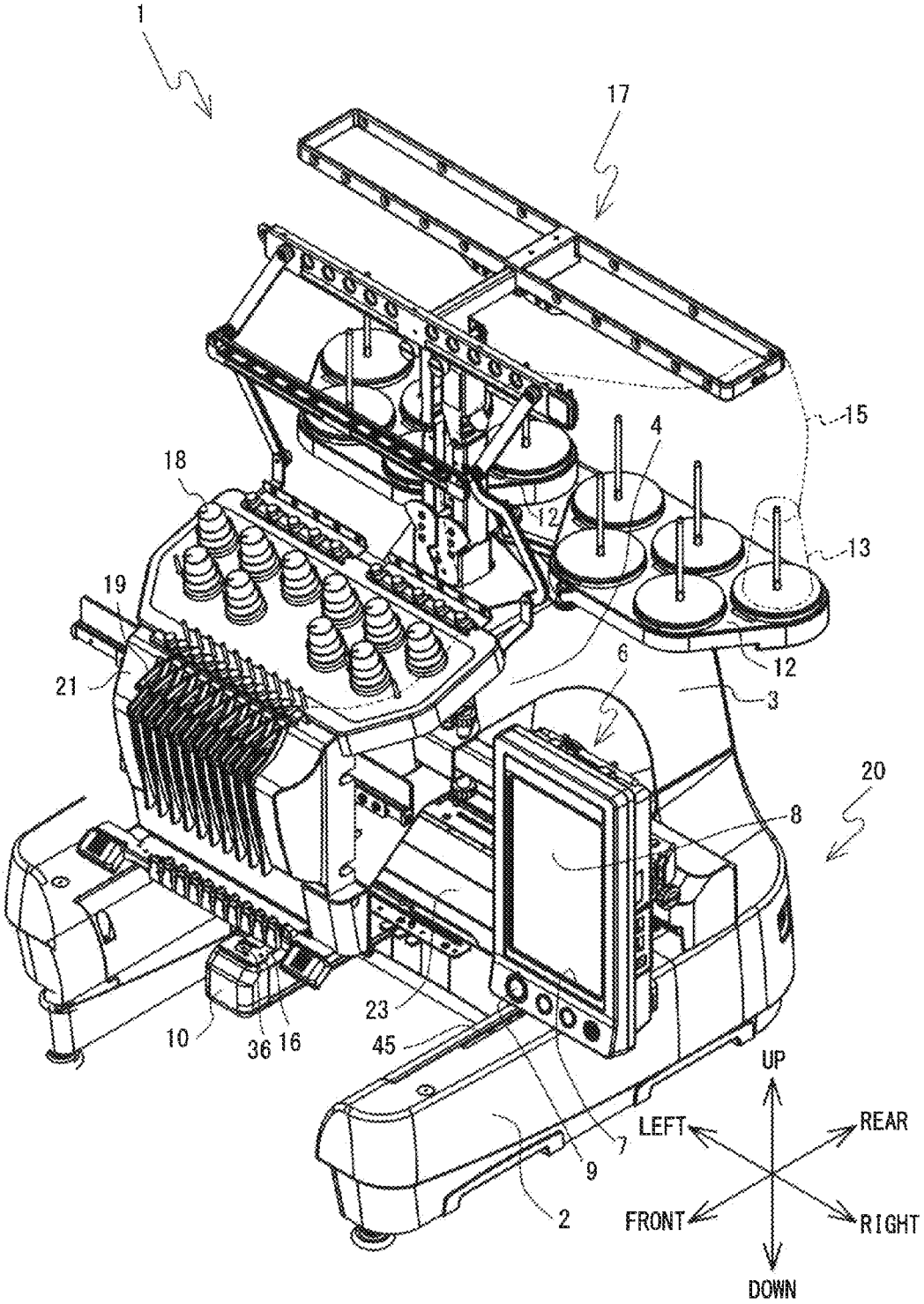
FIG. 1 is a perspective view of a sewing machine.

As shown in FIG. 1, a main body 20 of the sewing machine 1 is mainly provided with a support portion 2, a pillar 3 and an arm portion 4. The support portion 2 is a base portion that is formed in a reverse U shape in a plan view. A pair of left and right guide grooves 45 (only the guide groove 45 on the right side is shown in FIG. 1), which extend in the front-rear direction, are provided in the top surface of the support portion 2. The pillar 3 extends upward from a rear end portion of the support portion 2. The arm portion 4 extends to the front from an upper end portion of the pillar 3. A needle bar case 21 is attached to a front portion of the arm portion 4 such that the needle bar case 21 can move in the left-right direction. Ten needle bars 31 (refer to FIG. 2), which extend in the up-down direction, are arranged in the left-right direction inside the needle bar case 21 with a uniform interval between each of them. Of the ten needle bars 31, one of the needle bars 31 that is in a sewing position is moved in the up-down direction by a needle bar drive mechanism 32 (refer to FIG. 4) that is provided inside the needle bar case 21.

Figure 2:
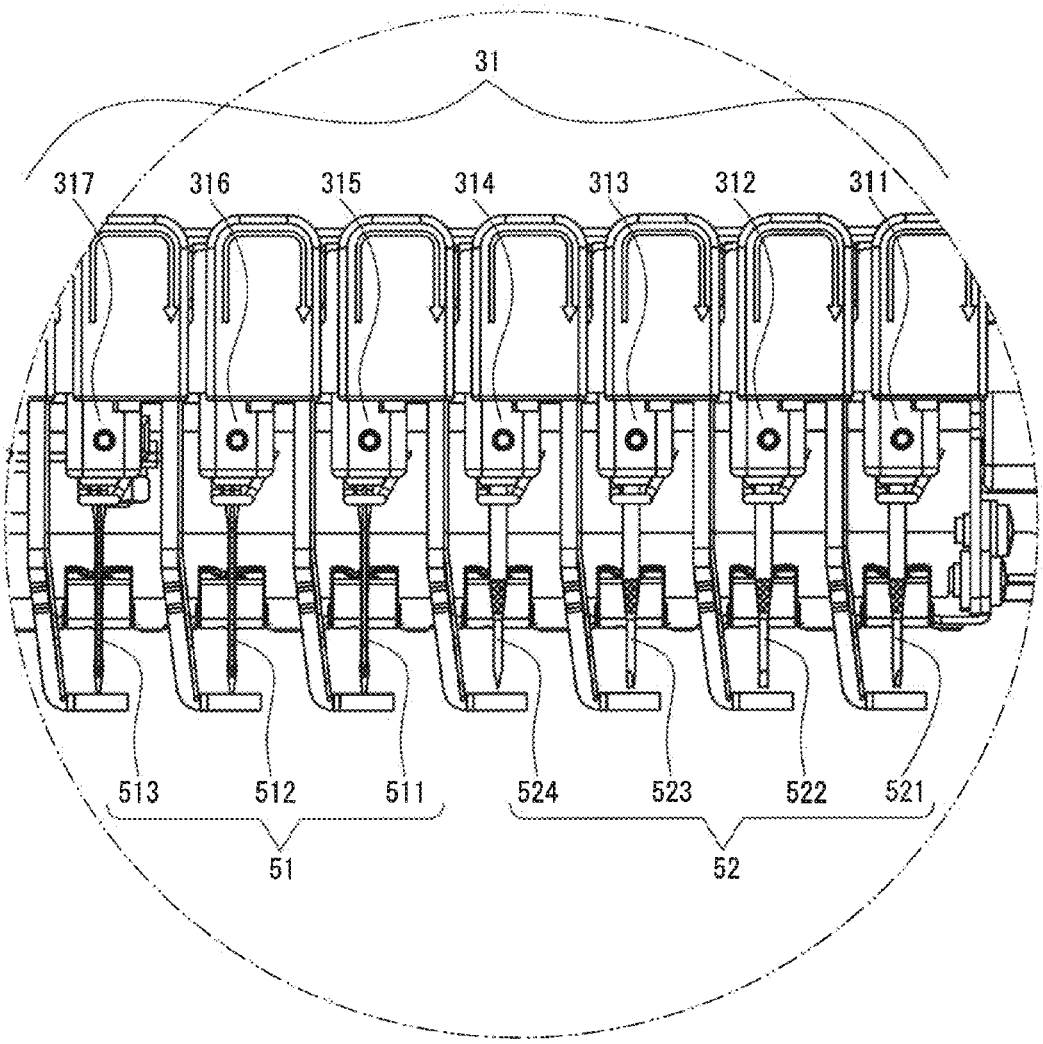
FIG. 2 is a front view of a cutting needle fixed to a needle bar.

A sewing needle 51 and a cutting needle 52 will be explained with reference to FIG. 2. In FIG. 2, of the ten needle bars 31, only the seven on the right side are illustrated. The sewing needle 51 or the cutting needle 52 can be selectively mounted on the lower end of each of the needle bars 31. FIG. 2 shows a state in which the sewing needles 51 (sewing needles 511, 512 and 513) are mounted on needle bars 315, 316 and 317, which are the fifth to the seventh needle bars 31 from the right. By sliding the needle bar 31 on which the sewing needle 51 is mounted and which is in the sewing position in the up-down direction, the sewing machine 1 causes the sewing needle 51 to repeatedly reciprocate in the up-down direction. In this way, the sewing machine 1 performs sewing on a sewing workpiece 39 (refer to FIG. 3). The sewing workpiece 39 is, for example, a work cloth.

FIG. 2 shows a state in which the cutting needles 52 (cutting needles 521, 522, 523 and 524) are mounted on needle bars 311, 312, 313 and 314, which are the first to fourth needle bars 31 from the right. The downward leading end of the cutting needle 52 is provided with a blade that is used to form cuts in the sewing workpiece 39 (refer to FIG. 3). A handle portion on the upper portion of the cutting needle 52 is a partially cylindrical shape that has a flat face on a side surface. A positional relationship between the direction of the blade and the flat face formed on the handle portion is different for each of the cutting needles 521 to 524. The cutting needle 52 can be mounted on the needle bar 31 in a state in which the flat face of the handle portion is faced toward the rear of the sewing machine 1. Thus, the plurality of sewing needles 52 can be mounted on the sewing machine 1 in a state in which each of the blades of the cutting needles 52 is in a different direction. The direction of the blade is an orientation of the blade when the cutting needle 52 forms the cuts in the sewing workpiece 39. In other words, the direction of the blade is referred to as the orientation of the cut formed in the sewing workpiece 39.

An operation portion 6 is provided on the arm portion 4 shown in FIG. 1, in a position further to the right side than a center portion of the arm portion 4 in the front-rear direction. The operation portion 6 is provided with a liquid crystal display (hereinafter referred to as an LCD) 7, a touch panel 8 and a start/stop switch 9. Based on image data, an image that includes various items, such as commands, illustrations, setting values and messages etc., is displayed on the LCD 7. The touch panel 8 is provided on a front surface of the LCD 7. A user can perform a pressing operation on the touch panel 8 using a finger or a touch pen. Hereinafter, this operation is referred to as a panel operation. The touch panel 8 detects a position that is pressed by the finger or the touch pen. The sewing machine 1 (more specifically, a CPU 61 that will be explained later) recognizes the item corresponding to the detected position. In this way, the sewing machine 1 recognizes the selected item. By the panel operation, the user can select a hole, a shape of a cut and an embroidery pattern to be formed on the sewing workpiece 39 and a command to be executed, and so on. The start/stop switch 9 is a switch that is used to input a command to start or to stop the sewing and the forming of the cuts by the sewing machine 1.

A cylinder bed 10, which is tubular and extends to the front from the lower end portion of the pillar 3, is provided below the arm portion 4. A shuttle (not shown in the drawings) is provided inside the leading end portion of the cylinder bed 10. A bobbin (not shown in the drawings) on which a lower thread (not shown in the drawings) is wound can be stored in the shuttle. A shuttle drive mechanism (not shown in the drawings) is provided inside the cylinder bed 10. The shuttle drive mechanism (not shown in the drawings) drives the shuttle to rotate. A needle plate 16, which is rectangular in a plan view, is provided on the upper surface of the cylinder bed 10. A needle hole 36, through which the sewing needle 51 can be inserted, is provided in the needle plate 16.

A pair of left and right thread spool stands 12 are provided on a rear portion of the top surface of the arm portion 4 shown in FIG. 1. The pair of the thread spool stands 12 are configured such that ten thread spools 13 can be mounted thereon, ten being the same as the number of the needle bars 31. Upper threads 15 are supplied from the thread spools 13 mounted on the thread spool stands 12. The upper threads 15 are supplied, via a thread guide 17, a tensioner 18, a thread take-up lever 19 and so on, to eyes (not shown in the drawings) of the sewing needles 51 (refer to FIG. 2) that are mounted on the lower end of the needle bars 31.

Figure 3:
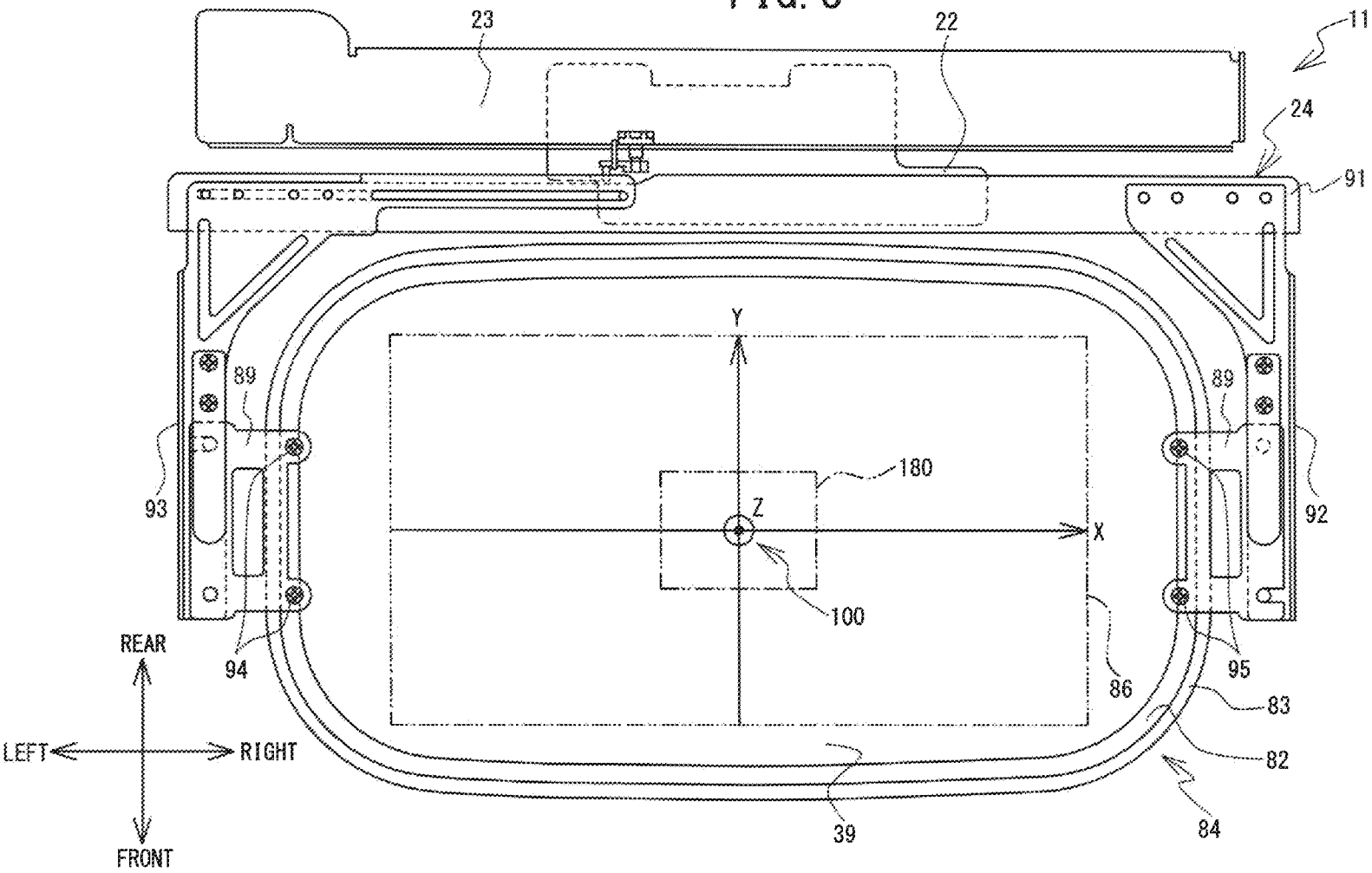
FIG. 3 is a plan view of an embroidery frame transport mechanism holding an embroidery frame.

A Y carriage 23 (refer to FIG. 1 and FIG. 3) of an embroidery frame movement mechanism 11 (refer to FIG. 3 and FIG. 4) is provided below the arm portion 4. The embroidery frame movement mechanism 11 is configured such that various types of an embroidery frame 84 (refer to FIG. 3) can be mounted thereon. As shown in FIG. 3, the embroidery frame 84 holds the sewing workpiece 39. The embroidery frame movement mechanism 11 moves the embroidery frame 84 in the front-rear direction and the left-right direction, using an X axis motor 132 (refer to FIG. 4) and a Y axis motor 134 (refer to FIG. 4) as drive sources.

The embroidery frame 84 and the embroidery frame movement mechanism 11 will be explained with reference to FIG. 3. The embroidery frame 84 is provided with an outer frame 83, an inner frame 82 and a pair of left and right connecting portions 89. The embroidery frame 84 clamps the sewing workpiece 39 between the outer frame 83 and the inner frame 82. Each of the connecting portions 89 is a plate member having a rectangular shape, in a plan view, in which a center portion is cut out in a rectangle. One of the connecting portion 89 is fixed to a right portion of the inner frame 82 by a screw 95. The other connecting portion 89 is fixed to a left portion of the inner frame 82 by a screw 94.

The embroidery frame movement mechanism 11 is provided with a holder 24, an X carriage 22, an X axis drive mechanism (not shown in the drawings), the Y carriage 23 and a Y axis movement mechanism (not shown in the drawings). The holder 24 supports the embroidery frame 84 such that the embroidery frame 84 can be mounted and detached. The holder 24 is provided with an attachment portion 91, a right arm portion 92 and a left arm portion 93. The attachment portion 91 is a plate member having a rectangular shape in a plan view, and is long in the left-right direction. The right arm portion 92 extends in the front-rear direction. The rear end portion of the right arm portion 92 is fixed to the right end of the attachment portion 91. The left arm portion 93 extends in the front-rear direction. The rear end portion of the left arm portion 93 is fixed at a left portion of the attachment portion 91 such that a position of the left arm portion 93 can be adjusted with respect to the attachment portion 91 in the left-right direction. The right arm portion 92 engages with one of the connecting portion 89. The left arm portion 93 engages with the other of the connecting portions 89.

The X carriage 22 is a plate member that is long in the left-right direction. A portion of the X carriage 22 protrudes to the front from the front surface of the Y carriage 23. The attachment portion 91 of the holder 24 can be attached to the X carriage 22. The X axis drive mechanism (not shown in the drawings) is provided with a linear movement mechanism (not shown in the drawings). The linear movement mechanism is provided with a timing pulley (not shown in the drawings) and a timing belt (not shown in the drawings). The linear movement mechanism moves the X carriage 22 in the left-right direction (an X direction), using the X axis motor 132 as a driving source.

The Y carriage 23 is a box-shaped member that is long in the left-right direction. The Y carriage 23 supports the X carriage 22 such that the X carriage 22 can move in the left-right direction. The Y axis movement mechanism (not shown in the drawings) is provided with a pair of left and right moving bodies (not shown in the drawings) and a linear movement mechanism (not shown in the drawings). The moving bodies are connected to a lower portion on both the left and right ends of the Y carriage 23, and penetrate through the guide grooves 45 (refer to FIG. 1) in the up-down direction. The linear movement mechanism is provided with a timing pulley (not shown in the drawings) and a timing belt (not shown in the drawings). The linear movement mechanism moves the moving bodies along the guide grooves 45 in the front-rear direction (a Y direction), using the Y axis motor 134 as a driving source. The Y carriage 23, to which the moving bodies are connected, and the X carriage 22 that is supported by the Y carriage 23 move in the front-rear direction (the Y direction) in accordance with the movement of the moving bodies. In a state in which the embroidery frame 84 that is holding the sewing workpiece 39 is mounted on the X carriage 22, the sewing workpiece 39 is arranged between the needle bars 31 (refer to FIG. 2) and the needle plate 16 (refer to FIG. 1).

Figure 4:
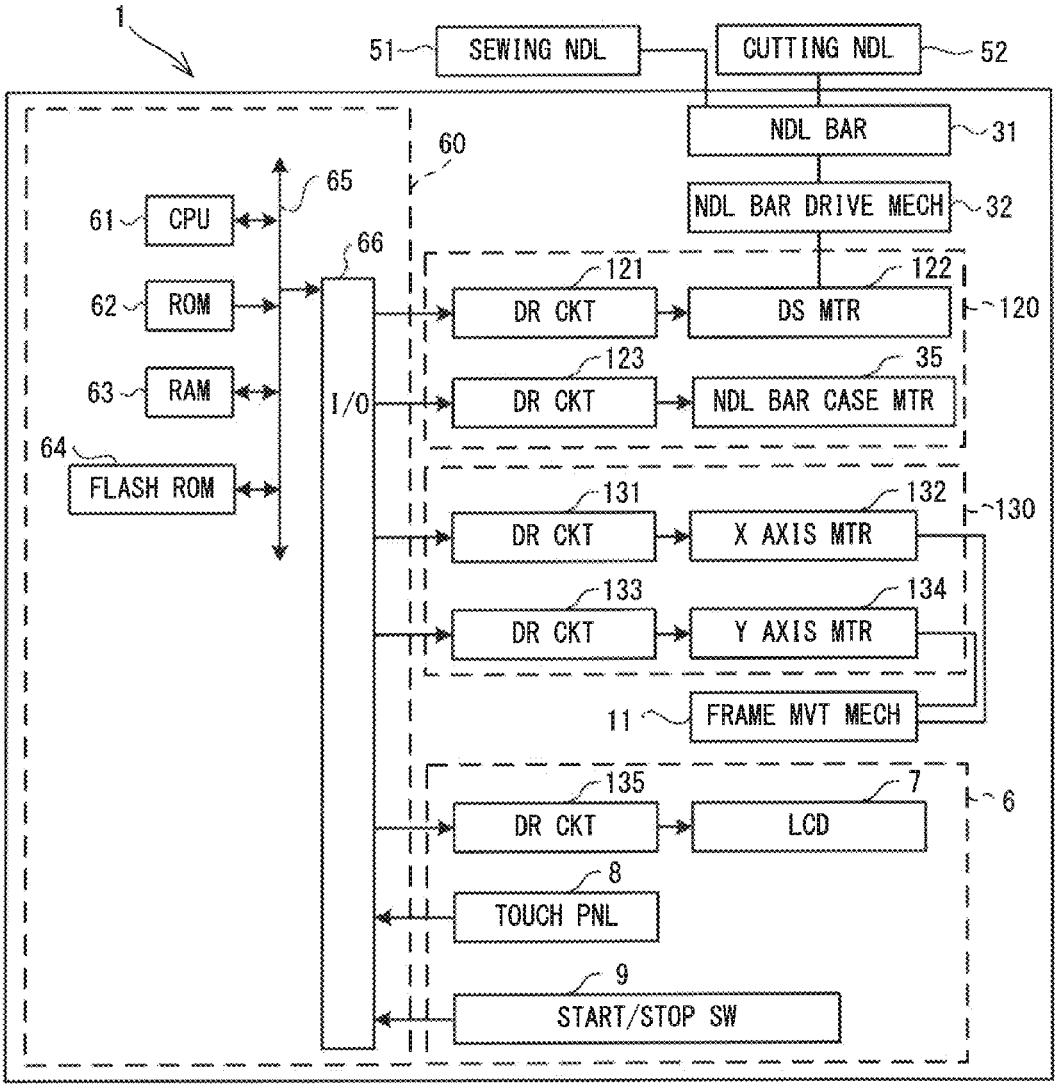
FIG. 4 is a block diagram showing an electrical configuration of the sewing machine.

An electrical configuration of the sewing machine 1 will be explained with reference to FIG. 4. As shown in FIG. 4, the sewing machine 1 is provided with a sewing needle drive portion 120, a sewing workpiece drive portion 130, the operation portion 6 and a control portion 60.

The sewing needle drive portion 120 is provided with a drive circuit 121, a drive shaft motor 122, a drive circuit 123 and a needle bar case motor 35. The drive circuit 121 drives the drive shaft motor 122 in accordance with a control signal from the control portion 60. The drive shaft motor 122 causes the needle bar 31 that is in the sewing position to move up and down, by driving the drive shaft (not shown in the drawings) to rotate and thus driving the needle bar drive mechanism 32. The cutting needle 52 and the sewing needle 51 can be selectively mounted on the needle bar 31. The drive circuit 123 drives the needle bar case motor 35 in accordance with a control signal from the control portion 60. The needle bar case motor 35 moves the needle bar case 21 (refer to FIG. 1) in the left-right direction, by driving a drive mechanism that is not shown in the drawings.

The sewing workpiece drive portion 130 is provided with a drive circuit 131, the X axis motor 132, a drive circuit 133 and the Y axis motor 134. The drive circuit 131 drives the X axis motor 132 in accordance with a control signal from the control portion 60. The X axis motor 132 moves the embroidery frame 84 (refer to FIG. 3) in the left-right direction by driving the embroidery frame movement mechanism 11. The drive circuit 133 drives the Y axis motor 134 in accordance with a control signal from the control portion 60. The Y axis motor 134 moves the embroidery frame 84 in the front-rear direction by driving the embroidery frame movement mechanism 11.

The operation portion 6 is provided with a drive circuit 135, the LCD 7, the touch panel 8 and the start/stop switch 9. The drive circuit 135 drives the LCD 7 in accordance with a control signal from the control portion 60.

The control portion 60 is provided with the CPU 61, a ROM 62, a RAM 63, a flash ROM 64 and an input/output interface (I/O) 66, which are mutually connected by a signal wire 65. The sewing needle drive portion 120, the sewing workpiece drive portion 130 and the operation portion 6 are each connected to the I/O 66.

The CPU 61 performs main control of the sewing machine 1 and executes various arithmetic calculations and processing relating to sewing, in accordance with various programs stored in a program storage area (not shown in the drawings) of the ROM 62. Although not shown in the drawings, the ROM 62 is provided with a plurality of storage areas, including the program storage area. Various programs to operate the sewing machine 1, including an embroidery data generating program that will be explained later, are stored in the program storage area. The embroidery data generating program is a program to execute embroidery data generating processing (refer to FIG. 5) that will be explained later. The embroidery data generating program may be stored in the flash ROM 64. Storage areas are provided as necessary in the RAM 63 in order to store data of arithmetic calculation results etc. of arithmetic calculation processing by the CPU 61.

A correspondence relationship between a needle bar number and a blade direction (a direction of the blade of the cutting needle 52 mounted on the needle bar 31 indicated by the needle bar number) or a thread color (a color of the thread supplied to the sewing needle 51 mounted on the needle bar 31 indicated by the needle bar number) is stored in the flash ROM 64. The needle bar number is, for example, a number that is allocated to each of the needle bars 31 in order to distinguish each of the ten needle bars 31, and the numbers 1 to 10 are allocated in order from the right side. In addition, various parameters used by the sewing machine 1 to execute various processing are stored in the flash ROM 64.

Next, a relationship between a hole that is to be formed in the sewing workpiece 39 and cutting data will be explained. The ROM 62 or the flash ROM 64 shown in FIG. 4 stores cutting data of a hole that is to be formed in the sewing workpiece 39 (refer to FIG. 3), according to a type of the hole. In addition to a circle, an ellipse and a polygonal shape etc., the type of the hole also includes an irregular shape, for example. By a panel operation, the user selects a desired hole from among a plurality of hole candidates that are displayed on the LCD 7.

The cutting data is control data that is necessary to cause the sewing machine 1 to perform an operation to form the hole of the shape selected by the panel operation, by forming cuts in the sewing workpiece 39 using the cutting needles 52 of the sewing machine 1. The cutting data of the present embodiment includes coordinate data of each of needle drop points of the cutting needle 52 in an embroidery coordinate system 100 (refer to FIG. 3) that will be explained later, cutting needle data relating to an order in which the cutting needle 52 pierces each of the needle drop points and a corresponding needle bar number, shape data that indicates a shape of a hole, mask data of the hole, and coordinate data of a center point of the hole. The mask data is data indicating a minimum rectangle that encompasses the hole shape. The center point is set as an intersection point of diagonal lines of the rectangular shape corresponding to the mask data. The cutting data is an example of hole data of the present disclosure.

When the user has selected a specific hole shape by the panel operation, for example, the sewing machine 1 moves the embroidery frame 84 based on the cutting data corresponding to the selected hole. In this way, a holding position of the sewing workpiece 39 with respect to the cutting needle 52 changes. Further, the sewing machine 1 moves the needle bar 31 on which the cutting needle 52 is mounted in the up-down direction. In this way, the cutting needle 52 cuts the sewing workpiece 39 by reciprocating in the up-down direction and repeatedly piercing the sewing workpiece 39. In this manner, the hole of the shape selected by the panel operation is formed in the sewing workpiece 39.

Next, a relationship between an embroidery pattern and embroidery data will be explained. The user adheres a water-soluble sheet onto the sewing workpiece 39 in which the hole has been formed. By sewing an embroidery pattern on the water-soluble sheet, the sewing machine 1 can arrange the embroidery pattern inside the hole. Note that the sheet on which the embroidery pattern is sewn is not limited to the water-soluble sheet and a sheet of another material may be used, as long as it is a sheet that dissolves in a specified solvent. By a panel operation, the user can select the embroidery pattern to be arranged on the inside of the hole, from among a plurality of embroidery pattern candidates displayed on the LCD 7. The ROM 62 or the flash ROM 64 shown in FIG. 4 stores embroidery data of the embroidery patterns. The embroidery data includes coordinate data of needle drop points of the sewing needle 51 in the embroidery coordinate system 100 (refer to FIG. 3), stitch data that indicates a type and a setting value of a stitch of the embroidery pattern, thread color data that represents a color of thread, contour data that indicates a contour of the embroidery pattern in the embroidery coordinate system 100, mask data of the embroidery pattern and coordinate data of a center point of the embroidery pattern. The type of the stitch of the embroidery pattern is, for example, a satin stitch, a fill stitch and the like. The setting value is, for example, an angle and a thread density of the stitch. The mask data is data indicating a minimum rectangle that encompasses the embroidery pattern. The center point is set as an intersection point of diagonal lines of the rectangular shape corresponding to the mask data. The user can edit the desired embroidery pattern using a pattern edit function of the sewing machine 1, and can cause the sewing machine 1 to generate embroidery data to form the embroidery pattern.

The embroidery coordinate system 100 will be explained with reference to FIG. 3. The embroidery coordinate system 100 is a coordinate system of the X axis motor 132 and the Y axis motor 134 that move the X carriage 22. The embroidery frame 84 that holds the sewing workpiece 39 is mounted on the X carriage 22. Thus, the coordinate data of the embroidery coordinate system 100 represents positions of the hole and the embroidery pattern with respect to the sewing workpiece 39 held by the embroidery frame 84.

In the embroidery coordinate system 100, the direction from the left toward the right of the sewing machine 1 is an X plus direction and the direction from the front toward the rear of the sewing machine 1 is a Y plus direction. In the present embodiment, an initial position of the embroidery frame 84 is an origin point (X, Y, Z)=(0, 0, 0) of the embroidery coordinate system 100. The initial position of the embroidery frame 84 is a position at which a center point of a sewable area 86 corresponding to the embroidery frame 84 is aligned with a needle drop point. The needle drop point is a point at which, when the needle bar 31 is moved downward from above the sewing workpiece 39, the sewing needle 51 or the cutting needle 52 (refer to FIG. 2) that is arranged vertically above a needle hole 36 (refer to FIG. 1) pierces the sewing workpiece 39. The embroidery frame movement mechanism 11 of the present embodiment does not move the embroidery frame 84 in a Z direction (the up-down direction of the sewing machine 1). Thus, within a range in which the thickness of the sewing workpiece 39 can be ignored, the Z coordinate on the top surface of the sewing workpiece 39 is assumed to be zero.

The coordinate data of the cutting data stored in the ROM 62 or the flash ROM 64 prescribes an initial arrangement of the hole. The initial arrangement of the hole of the present embodiment is a position at which the center point of the hole and the origin point of the embroidery coordinate system 100 (the center point of the sewable area 86) are aligned with each other. The coordinate data of the cutting data is corrected as appropriate when the arrangement of the hole with respect to the sewing workpiece 39 is changed.

The coordinate data of the embroidery data stored in the ROM 62 or the flash ROM 64 prescribes an initial arrangement of the embroidery pattern. In the initial arrangement of the embroidery pattern of the present embodiment, the center point of the embroidery pattern and the origin point of the embroidery coordinate system 100 (the center point of the sewable area 86) are aligned with each other. The coordinate data of the embroidery data is corrected as appropriate when the arrangement of the embroidery pattern with respect to the sewing workpiece 39 is changed.

Figure 5:
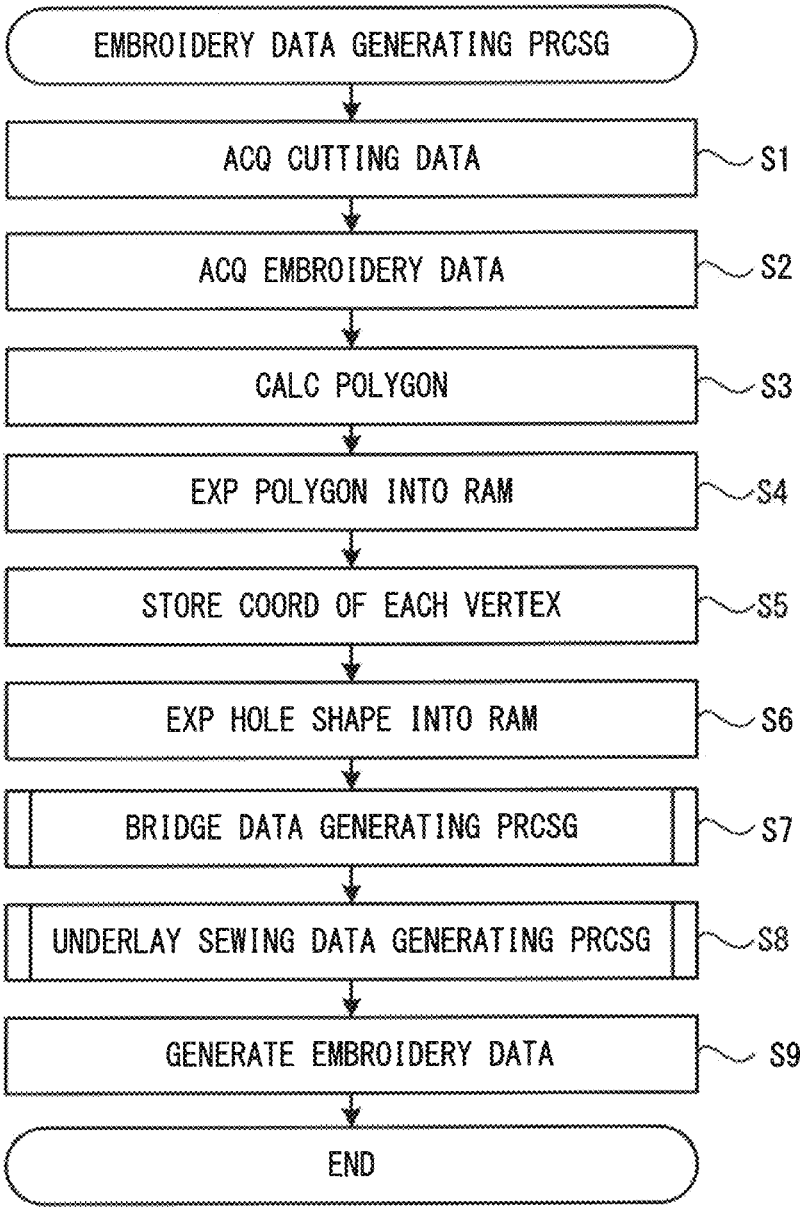
FIG. 5 is a flowchart of embroidery data generating processing.

Embroidery data generating processing that is performed by the CPU 61 will be explained with reference to FIG. 5 to FIG. 24, using a specific example. Processing shown in FIG. 5 is performed in order to generate embroidery data that can perform embroidery pattern sewing, bridge sewing and underlay sewing inside a hole formed in the sewing workpiece 39. The bridge sewing refers to forming stitches in which an outer edge portion of an embroidery pattern and a peripheral edge portion of a hole are joined by run stitches. The underlay sewing refers to forming stitches that are sewn in advance of the sewing of the embroidery pattern and that are covered by the embroidery pattern that is sewn afterward. An instruction to start this processing is, for example, input by the user by a panel operation. When the start instruction is input, the CPU 61 reads out the embroidery data generating program from the ROM 62 (refer to FIG. 4) and performs the processing.

Figure 6:
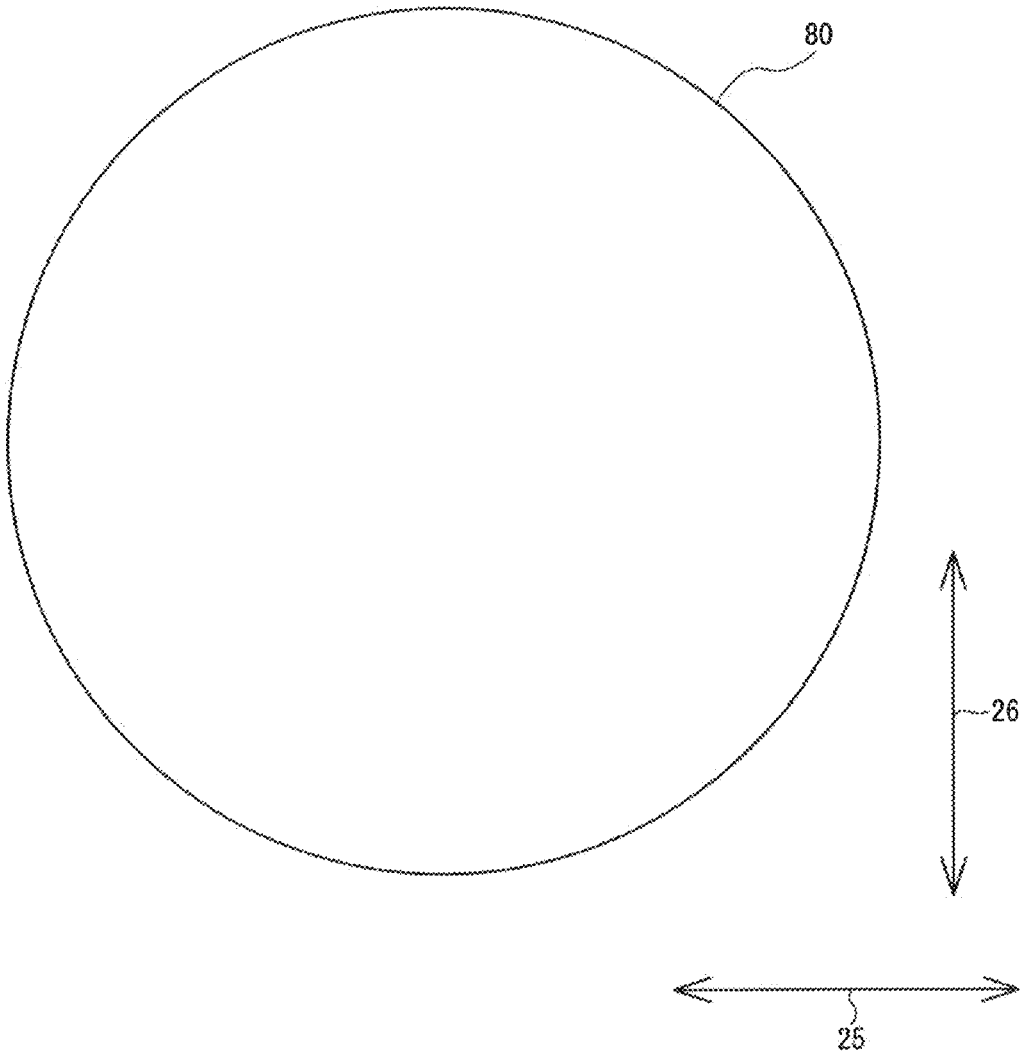
FIG. 6 is a schematic diagram showing a circular hole.

First, by a panel operation by the user, a hole that is to be formed in the sewing workpiece 39 is selected. In a present specific example, a case is assumed in which a circular hole 80 shown in FIG. 6 is selected. In FIG. 6, a left-right direction 25 and an up-down direction 26 respectively correspond to the X direction and the Y direction of the embroidery coordinate system 100.

Figure 7:
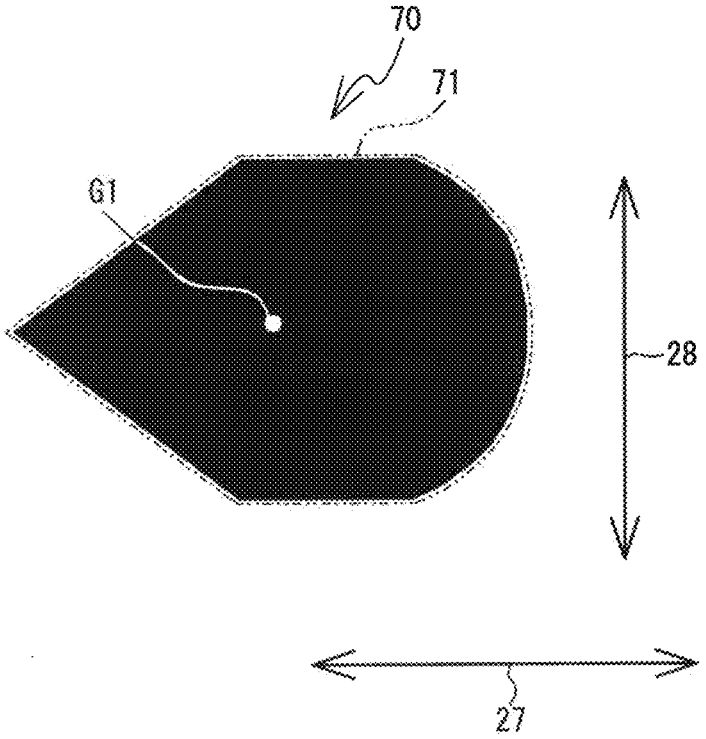
FIG. 7 is a schematic diagram of an embroidery pattern.

The CPU 61 acquires cutting data corresponding to the selected hole 80 from the flash ROM 64 (step S1). The CPU 61 stores the acquired cutting data in the RAM 63. When the selection of the hole 80 is complete, next an embroidery pattern is selected by a panel operation by the user. In the present specific example, a case is assumed in which an embroidery pattern 70 shown in FIG. 7 is selected. The embroidery pattern 70 is a pattern of fill stitches, for example, that is to be sewn using a predetermined thread (in FIG. 7, a surface of the pattern is omitted and colored in black). A contour shape of the embroidery pattern 70 is a shape in which, at the same time as one side of an equilateral triangle is connected to a left side of a rectangle, a right side of the rectangle (the side opposing the left side) bulges to the right in a substantially fan shape. In FIG. 7, a left-right direction 27 and an up-down direction 28 respectively correspond to the X direction and the Y direction of the embroidery coordinate system 100. The CPU 61 acquires embroidery data corresponding to the embroidery pattern 70 selected by the panel operation from the flash ROM 64 (step S2). The CPU 61 stores the acquired embroidery data in the RAM 63.

Next, the CPU 61 performs polygonal shape calculation processing (step S3), based on contour data that is included in the embroidery data stored in the RAM 63. The polygonal shape calculation processing is processing to calculate a minimum convex polygon that encompasses a contour 71 (refer to FIG. 7) of the embroidery pattern 70 represented by the contour data. A method of calculating the minimum convex polygon is not particularly limited. In the present embodiment, it is possible to acquire (calculate) the minimum convex polygon that encompasses the contour 71, using a "convex closure", for example. The convex closure refers to a minimum convex set which includes a set of points on the graphic.

Various algorithms to obtain the minimum convex polygon using the convex closure are available, including the Graham method. In the Graham method, processing is performed as follows. First, of points that are included in the graphic, the lowest point is targeted. Then, other points are sorted in order of angle of deviation from the targeted point and computed using numbered triangles in order. In addition to the Graham method, various other algorithms can also be applied. For example, the Melkman algorithm or the Sklansky algorithm or the like can be used (refer to Japanese Patent Application No. 2006-511065, page 18, line 6 to line 43, for example).

Figure 8:
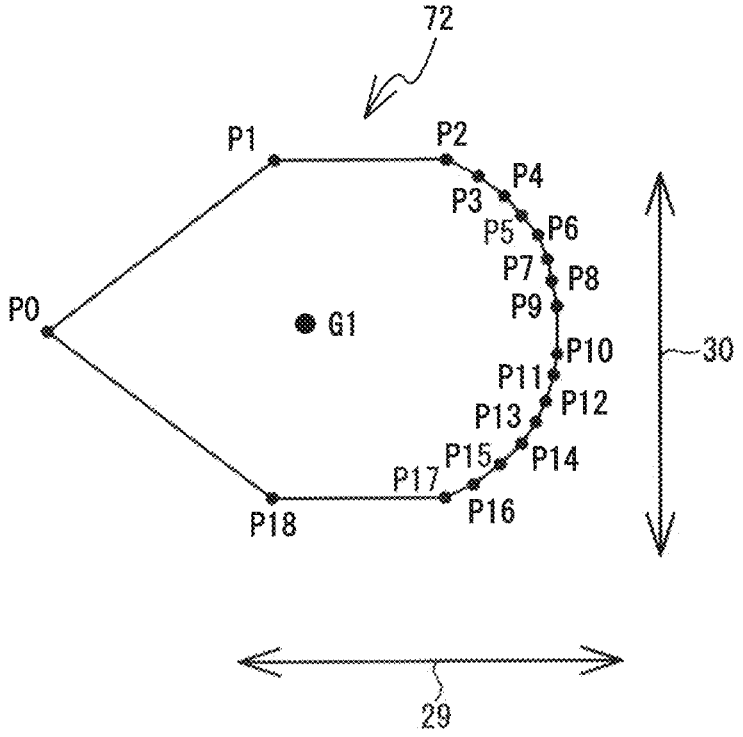
FIG. 8 is a schematic diagram of a polygon.

As shown in FIG. 8, the CPU 61 acquires a minimum convex polygon 72 that encompasses the contour 71 shown in FIG. 7, based on the convex closure, and expands contour data of the acquired polygon 72 into the RAM 63 (step S4). The CPU 61 causes a center point G1 of the polygon 72 to be aligned with the origin point of the embroidery coordinate system 100. In FIG. 8, a left-right direction 29 and an up-down direction 30 respectively correspond to the X direction and the Y direction of the embroidery coordinate system 100. In the present embodiment, the center point G1 of the polygon 72 is in the same position as a center point of the embroidery pattern 70. The center point of the embroidery pattern 70 is acquired by referring to coordinate data of the center point of the embroidery pattern 70 included in the embroidery data stored in the RAM 63.

Next, of each of vertices of the polygon 72, the CPU 61 allocates the reference P0 to the vertex furthest to the left side, and allocates in order P1, P2 . . . as vertex numbers to each of the other vertices in a right-hand rotation from P0. Another method to the above method may be used to allocate the vertex numbers. For example, P1, P2 . . . may be allocated in order to the other vertices from the first vertex P0 in a left-hand rotation. In the present embodiment, vertex numbers P0 to P18 are respectively allocated to 19 vertices of the polygon 72. The CPU 61 stores coordinate positions of each of the vertices P0 to P18 in the RAM 63 (step S5).

Figure 9:
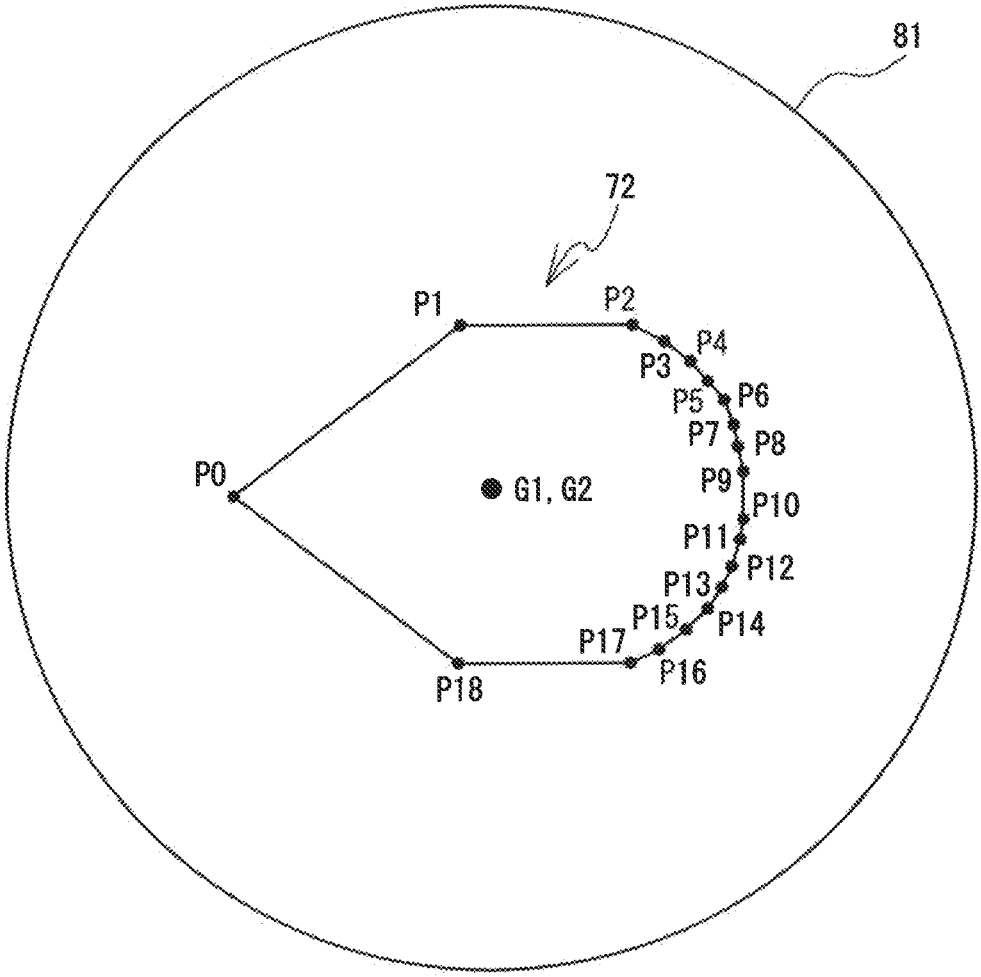
FIG. 9 is a diagram in which a circle and the polygon are arranged in an overlapping manner.

Next, as shown in FIG. 9, the CPU 61 reads out circular data (hereinafter simply referred to as a circle) 81, which is shape data of the hole 80 included in the cutting data stored in the RAM 63, and expands the read out circular data 81 into the RAM 63 (step S6). The CPU 61 causes a center point G2 of the circle 81 to be aligned with the origin point of the embroidery coordinate system 100. The center point G1 of the polygon 72 and the center point G2 of the circle 81 are aligned with each other. Thus, the polygon 72 is arranged in the center of the circle 81.

Next, the CPU 61 performs bridge data generating processing (step S7). The bridge data generating processing is processing to determine bridging positions that join each of the vertices of the polygon 72 and a peripheral edge portion of the circle 81 and to generate the bridge data.

Figure 10:
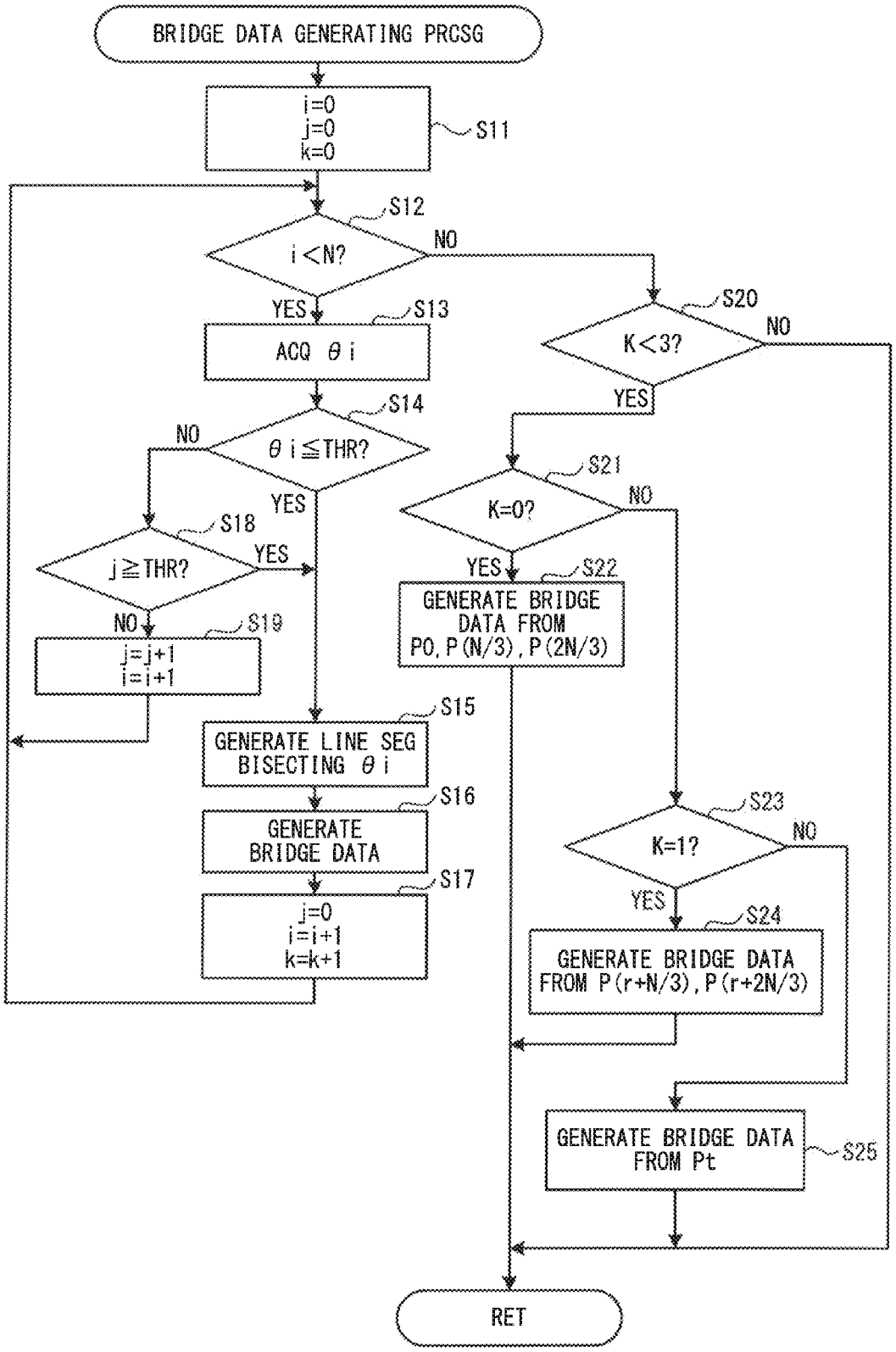
FIG. 10 is a flowchart of bridge data generating processing.
Figure 11:
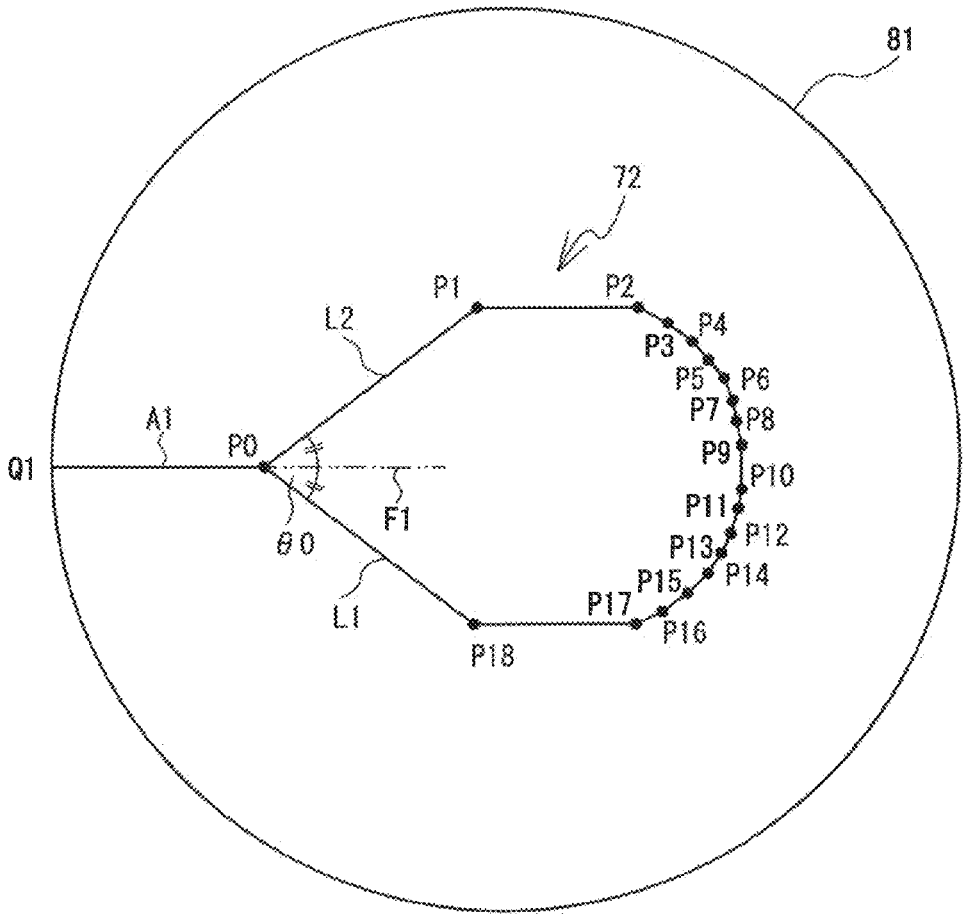
FIG. 11 is a diagram showing an arrangement of a line segment A1.
Figure 12:
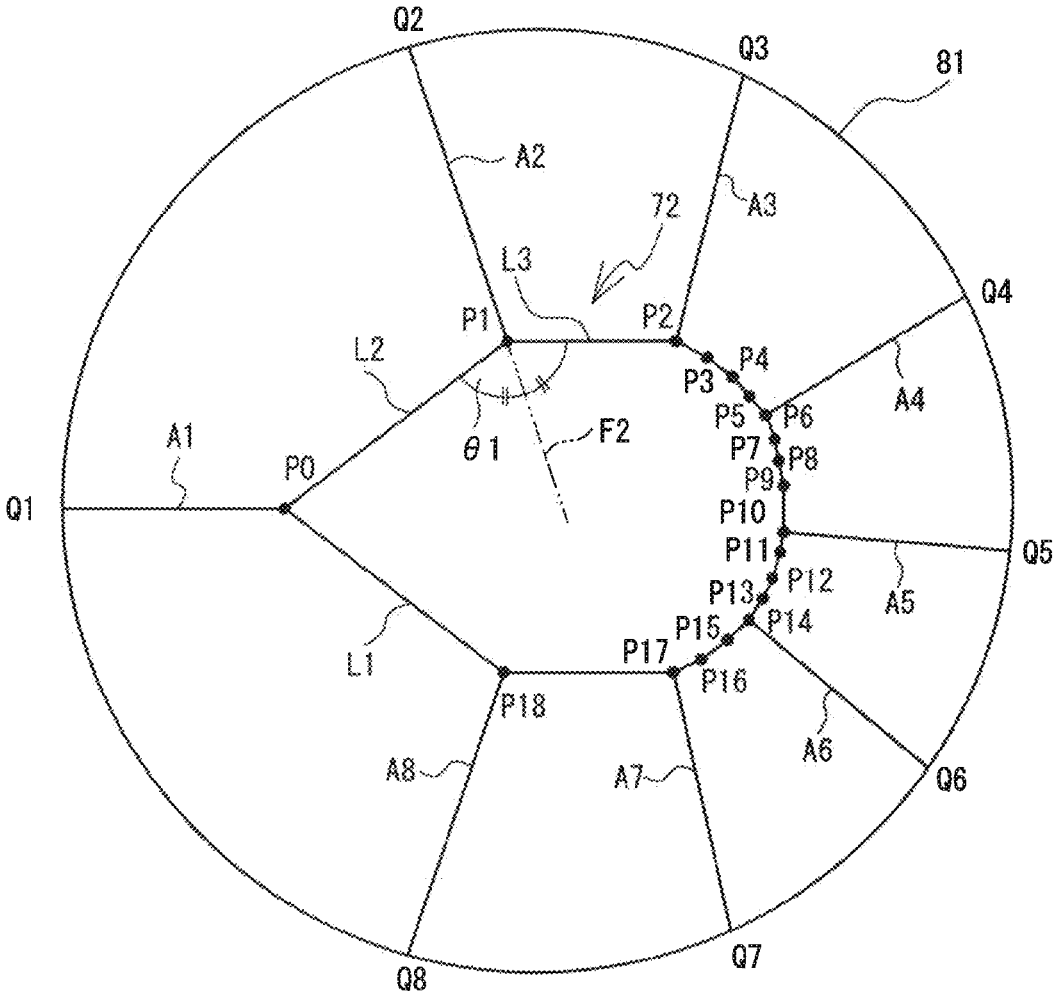
FIG. 12 is a diagram showing respective arrangements of the line segments A1 to A8.

The bridge data generating processing will be specifically explained using a specific example, with reference to FIG. 10 to FIG. 12. First, as shown in FIG. 10, the CPU 61 sets variables i, j and k to 0 (zero) (step S11). The variable i is a variable that is used to indicate a vertex number of the polygon 72. The variable j is a variable that is used to count the vertices for which a bridge line segment is not generated. The variable k is a variable that is used to count a number of bridge line segments that are generated for the polygon 72. The CPU 61 stores the variables i, j and k in the RAM 63, for example. The bridge line segment refers to a line segment that joins the vertex of the polygon 72 to the peripheral edge portion of the circle 81. In the following explanation, the bridge line segment is sometimes simply referred to as a "line segment" (such as a "line segment A1" and so on, for example).

Next, the CPU 61 determines whether or not the variable i is smaller than N (step S12). N is a number corresponding to a maximum number of the vertex numbers of the polygon 72. In the present specific example, N is 18 (refer to FIG. 11). When the processing advances from step S11 to step S12, the variable i is 0 and is smaller than 18 (YES at step S12) and thus, the CPU 61 advances the processing to step S13. At step S13, the CPU 61 acquires (calculates) an angle θi of a vertex Pi. In the processing at step S13 this time, the CPU 61 acquires an angle θ0 of the vertex P0. As shown in FIG. 11, the angle θ0 is an angle formed by sides L1 and L2 that form the vertex P0. The side L1 is a line segment that joins the vertex P0 and the vertex P18. The side L2 is a line segment that joins the vertex P0 and the vertex P1.

Next, the CPU 61 determines whether or not the angle θi is equal to or less than a threshold value (step S14). The threshold value of the angle θi is, for example, 150 degrees. In the processing at step S14 this time, the angle θ0 is 60° and is thus equal to or less than the threshold value (YES at step S14), and the vertex P0 is a convex portion having a relatively prominent sharp leading end. As a result, it is preferable that a convex portion corresponding to the vertex P0 of the embroidery pattern 70 shown in FIG. 7 is connected to the peripheral edge portion of the hole by bridging. Here, the CPU 61 generates a line segment that joins the vertex Pi and the circle 81 on a virtual straight line that equally bisects the angle θi of the vertex Pi (step S15). In the processing at step S15 this time, as shown in FIG. 11, the CPU 61 generates the line segment A1, on a virtual straight line F1 that equally bisects the angle θ0 of the vertex P0. The line segment A1 is a line segment that joins the vertex P0 and an intersection point Q1 at which the virtual straight line F1 and the circle 81 intersect. Further, the CPU 61 generates bridge data (step S16) for the generated line segment (the line segment A1 in this case). The bridge data is data of a run stitch that connects two end points (the vertex P0 and the intersection point Q1) of the line segment A1. The CPU 61 stores the generated bridge data of the line segment in the RAM 63. The CPU 61 initializes the variable j to 0, adds 1 to the variable i, and adds 1 to the variable k (step S17). By the processing at step S17 this time, the variable j becomes 0, the variable i becomes 1 and the variable k becomes 1. The CPU 61 returns the processing to step S12.

Next, as now the variable i is 1 (YES at step S12), the CPU 61 acquires the angle θ1 of the vertex P1 (step S13). As shown in FIG. 12, the angle θ1 is an angle formed by the side L2 and a side L3. The side L2 is the line segment that joins the vertex P0 and the vertex P1. The side L3 is a line segment that joins the vertex P1 and the vertex P2. The angle θ1 is 142.92° and is equal to or less than the threshold value (YES at step S14), and the vertex P1 is also a relatively prominent convex portion. Thus, the CPU 61 generates a line segment A2 on a virtual straight line F2 that equally bisects the angle θ1 of the vertex P1 (step S15). The line segment A2 is a line segment that joins the vertex P1 and an intersection point Q2 at which the virtual straight line F2 and the circle 81 intersect. Further, the CPU 61 generates bridge data of the line segment A2 (step S16). The bridge data is data of a run stitch that connects two end points (the vertex P1 and the intersection point Q2) of the line segment A2. The CPU 61 stores the bridge data of the line segment A2 in the RAM 63. The CPU 61 initializes the variable j to 0, adds 1 to the variable i and adds 1 to the variable k (step S17). By the processing at step S17 this time, the variable j becomes 0, the variable i becomes 2 and the variable k becomes 2. The CPU 61 returns the processing to step S12, and sequentially repeats the processing for the vertex P2 and onward.

As shown in FIG. 12, an angle θ2 (not shown in FIG. 12) corresponding to the vertex P2 is equal to or less than the threshold value (YES at step S14), and the vertex P2 is also a relatively prominent convex portion. Thus, the CPU 61 generates a line segment A3 (step S15) on a virtual straight line (not shown in the drawings) that equally bisects the angle θ2 of the vertex P2. The line segment A3 is a line segment that joins the vertex P2 and an intersection point Q3 at which the virtual straight line and the circle 81 intersect. The angle θ2 is an angle formed by two sides that form the vertex P2. Further, the CPU 61 generates bridge data of the line segment A3 (step S16). The CPU 61 initializes the variable j to 0, adds 1 to the variable i and adds 1 to the variable k (step S17). By the processing at step S17 this time, the variable j becomes 0, the variable i becomes 3 and the variable k becomes 3. The CPU 61 returns the processing to step S12.

Next, the CPU 61 performs the processing corresponding to the vertex P3. An angle θ3 is larger than the threshold value (NO at step S14) and therefore, the vertex P3 is a relatively non-prominent convex portion. Thus, the CPU 61 does not generate bridge data and determines whether or not the variable j is equal to or more than a threshold value (step S18). The threshold value of the variable j is 3, for example. As now the variable j is 0 (NO at step S18), the CPU 61 adds 1 to the variable j and adds 1 to the variable i (step S19). By the processing at step S19 this time, the variable j becomes 1 and the variable i becomes 4. The variable k remains at 3. The CPU 61 returns the processing to step S12.

Next, the CPU 61 performs processing corresponding to the vertex P4. As an angle θ4 is larger than the threshold value (NO at step S14), the vertex P4 is also a relatively non-prominent convex portion. Thus, the CPU 61 does not generate bridge data and determines whether or not the variable j is equal to or more than the threshold value (step S18). As now the variable j is 1 (NO at step S18), the CPU 61 adds 1 to the variable j and adds 1 to the variable i (step S19). By the processing at step S19 this time, the variable j becomes 2 and the variable i becomes 5. The variable k remains at 3. The CPU 61 returns the processing to step S12.

Next, the CPU 61 performs processing corresponding to the vertex P5. As an angle θ5 is larger than the threshold value (NO at step S14), the vertex P5 is also a relatively non-prominent convex portion. Thus, the CPU 61 does not generate bridge data and determines whether or not the variable j is equal to or more than the threshold value (step S18). As the variable j is 2 (NO at step S18), the CPU 61 adds 1 to the variable j and adds 1 to the variable i (step S19). By the processing at step S19 this time, the variable j becomes 3 and the variable i becomes 6. The variable k remains at 3. The CPU 61 returns the processing to step S12.

Next, the CPU 61 performs processing corresponding to the vertex P6. As an angle θ6 is larger than the threshold value (NO at step S14), the vertex P6 is also a relatively non-prominent convex portion. Here, as the variable j is 3, a state arises in which, up to now, three vertices for which the bridging is not arranged have been continuous. Hypothetically, if there are many continuous vertices for which the bridging is not arranged, it is possible that the shape of the embroidery pattern 70 cannot be secured at that portion. Here, the CPU 61 advances the processing to step S15 by changing the determination at step S18 to YES, and generates a line segment A4 on a virtual straight line (not shown in the drawings) that equally bisects the angle θ6 of the vertex P6. The line segment A4 is a line segment that joins the vertex P6 and an intersection point Q4 at which the virtual straight line and the circle 81 intersect. Further, the CPU 61 generates bridge data of the line segment A4 (step S16). The CPU 61 stores the bridge data of the line segment A4 in the RAM 63. The CPU 61 initializes the variable j to 0, adds 1 to the variable i and adds 1 to the variable k (step S17). By the processing at step S17 this time, the variable j becomes 0, the variable i becomes 7 and the variable k becomes 4. The CPU 61 returns the processing to step S12.

Then, as shown in FIG. 12, the CPU 61 repeatedly performs the above-described processing for the remaining vertices P7 to P18 (step S12 to step S19). As a result of the processing, the CPU 61 respectively generates bridge data of a line segment A5, a line segment A6, a line segment A7 and a line segment A8 for the vertex P10 and the vertices P14, P17 and P18. Note that, although not explained in detail, the line segments A5 to A8 are line segments that, for the vertex P10, the vertex P14, the vertex P17 and the vertex P18 respectively, join the vertex Pi and an intersection point Qi at which each of virtual straight lines and the circle 81 intersect, on each of the virtual straight lines that equally bisects the angle θi of the vertex Pi.

At a point in time at which the processing of the final vertex P18 ends, the variable j becomes 0, the variable i becomes 18 and the variable k becomes 8. Around the polygon 72, the eight line segments A1 to A8 are arranged in the shape of a spider web. The eight pieces of bridge data corresponding to the line segments A1 to A8 are stored in the RAM 63.

Next, the CPU 61 returns the processing to step S12 and determines whether or not the variable i is smaller than N. As the variable i is 18 (NO at step S12), next, the CPU 61 determines whether or not the variable k is smaller than 3 (step S20). In order to hold the embroidery pattern inside the hole formed in the sewing workpiece 39 in a balanced manner, it is preferable for there to be at least three or more bridges. In the present specific example, as the variable k is 8 (NO at step S20), a sufficient number of pieces of bridge data have already been generated. Thus, the CPU 61 ends the bridge data generating processing and advances the processing to step S8 of the embroidery data generating processing shown in FIG. 5.

Note that, in contrast to the above-described specific example, depending on the shape of the polygon, there is a case in which it is not possible to generate three or more of the bridge line segments. Here, when the variable k is less than three (YES at step S20), the CPU 61 first determines whether or not the variable k is 0 (step S21). When the variable k is 0 (YES at step S21), the CPU 61 generates bridge data in a similar manner to the above-described method for the vertex P0, a vertex P(N/3) and a vertex P(2×N/3) (step S22). When the variable k is not 0 (NO at step S21), the CPU 61 determines whether or not the variable k is 1. When the variable k is 1 (YES at step S23), bridge data is generated in a similar manner to the above-described method for a vertex P(r+N/3) that is advanced by N/3 from a vertex Pr (for which the bridge data has already been generated) and a vertex P(r+2×N/3) that is further advanced by N/3 from the vertex P(r+N/3) (step S24). When the variable k is not 1 (NO at step S23), the variable k is therefore 2, and bridge data is generated in a similar manner to the above-described method for a vertex Pt closest to a virtual straight line in a direction to equally bisect a reflex angle formed by two pieces of bridge line segments (step S25).

Then, after the CPU 61 has generated the bridge data by the processing at one of step S22, step S24 and step S25, the CPU 61 ends the bridge data generating processing and advances the processing to step S8 of the embroidery data generating processing shown in FIG. 5.

The sewing machine 1 of the present embodiment generates the bridge data in the manner explained above. Thus, when the sewing machine 1 of the present embodiment performs sewing in accordance with the bridge data generated by the above-described processing, it is possible to generate at least three bridges around the embroidery pattern 70. The embroidery pattern 70 can be supported by at least three or more bridges inside the hole formed in the sewing workpiece 39. Therefore, the shape of the embroidery pattern 70 can be maintained without bending.

A modified example of the bridge data generating processing will be explained with reference to FIG. 11 to FIG. 13. In the bridge data generating processing shown in FIG. 10, when the angle θi of the vertex Pi of the polygon 72 is equal to or less than 150 degrees, the CPU 61 generates the bridge data for the vertex Pi. In the modified example, the CPU 61 generates the bridge data for the vertex Pi when a sum of lengths of two adjacent sides that form the vertex Pi of the polygon 72 is equal to or more than a threshold value. In bridge data generating processing shown in FIG. 13, in place of performing each of the processing at step S13 and step S14 in the bridge data generating processing shown in FIG. 10, each of processing at step S113 and step S114 is performed. Otherwise, all of the processing is the same as the bridge data generating processing shown in FIG. 10. Thus, the modified example will be explained focusing on each of the processing at step S113 and step S114.

Figure 13:
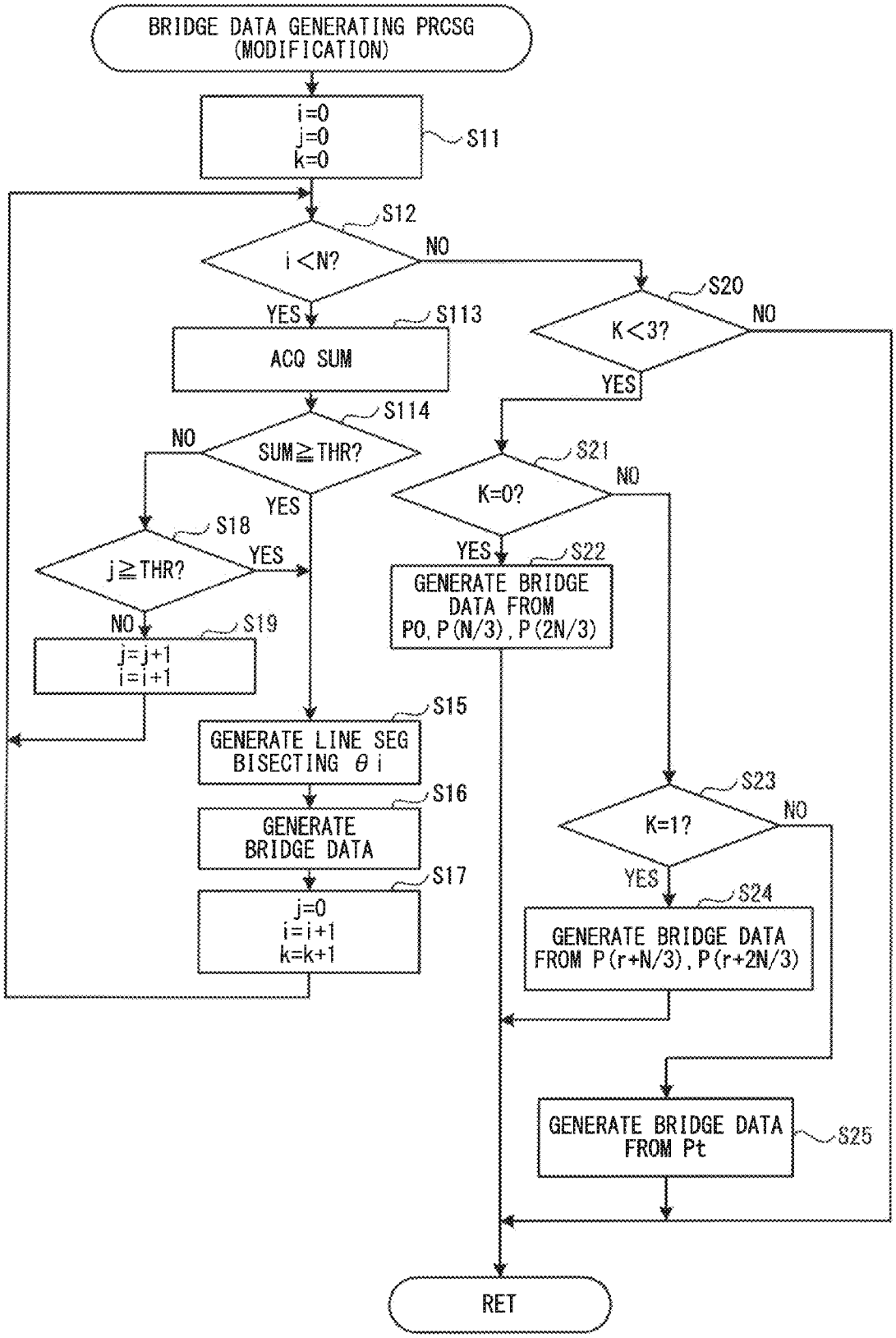
FIG. 13 is a flowchart of bridge data generating processing (a modified example)

First, as shown in FIG. 13, after setting the variables i, j and k to 0 (step S11), the CPU 61 determines whether or not the variable i is smaller than N (step S12). In this example, N is 18. As at first i=0 (YES at step S12), the CPU 61 advances the processing to step S113. At step S113, the CPU 61 acquires a sum of lengths of two sides that form the vertex Pi. In the processing at step S113 this time, the CPU 61 acquires (calculates) the sum of lengths of the side L1 and the side L2 that form the vertex P0. As shown in FIG. 11, the length of the side L1 is the length of the line segment joining the vertices P0 and P18. The length of the side L2 is the length of the line segment joining the vertices P0 and P1. The coordinate values of each of the vertices P0, P1 and P18 are stored in the RAM 63 (refer to step S5 in FIG. 5). The CPU 61 reads out the coordinate values of each of the vertices P0, P1 and P18 from the RAM 63 and, from the three sets of coordinate values, calculates the length of the side L1 and the length of the side L2, respectively.

Next, the CPU 61 determines whether or not the sum acquired at step S113 is equal to or more than a threshold value (step S114). The user can freely set the threshold value of the sum in accordance with the shape of the embroidery pattern. The greater the sum of the lengths of the two adjacent sides forming the vertex Pi, the more the vertex Pi is a relatively prominent convex portion. In contrast, the smaller the sum of the lengths of the two adjacent sides, the more the vertex Pi is a relatively non-prominent convex portion. In the processing at step S114 this time, the CPU 61 determines whether or not the sum of the lengths of the side L1 and the side L2 is equal to or more than the threshold value. As shown in FIG. 11, the sum of the lengths of the side L1 and the side L2 is equal to or more than the threshold value (YES at step S114), and the CPU 61 therefore generates the line segment A1 on the virtual straight line F1 that equally bisects the angle θ0 of the vertex P0 (step S15). Further, the CPU 61 generates the bridge data of the line segment A1 (step S16). The CPU 61 stores the bridge data of the line segment A1 in the RAM 63. The CPU 61 initializes the variable j to 0, adds 1 to the variable i and adds 1 to the variable k (step S17). The variable j becomes 0, the variable i becomes 1 and the variable k becomes 1. The CPU 61 returns the processing to step S12.

On the other hand, when the sum of the lengths of the two adjacent sides is less than the threshold value, for example (NO at step S114), the CPU 61 does not generate the bridge data and advances the processing to step S18. The processing after that is the same as the bridge data generating processing shown in FIG. 10. In this way, in the present modified example also, in a similar manner to the bridge data generating processing shown in FIG. 10, it is possible to arrange three or more bridge line segments around the polygon 72.

When the above-described bridge data generating processing is ended, the CPU 61 returns the processing to the embroidery data generating processing and performs underlay sewing data generating processing (step S8). The underlay sewing data generating processing is processing to determine a direction and a position of underlay sewing, inside a contour line of the polygon 72, and to generate underlay sewing data. In the present embodiment, the underlay sewing is a satin stitch, but may be another type of stitch, such as a run stitch or the like. The underlay sewing data is coordinate data of a needle drop point of the sewing needle 51.

Figure 14:
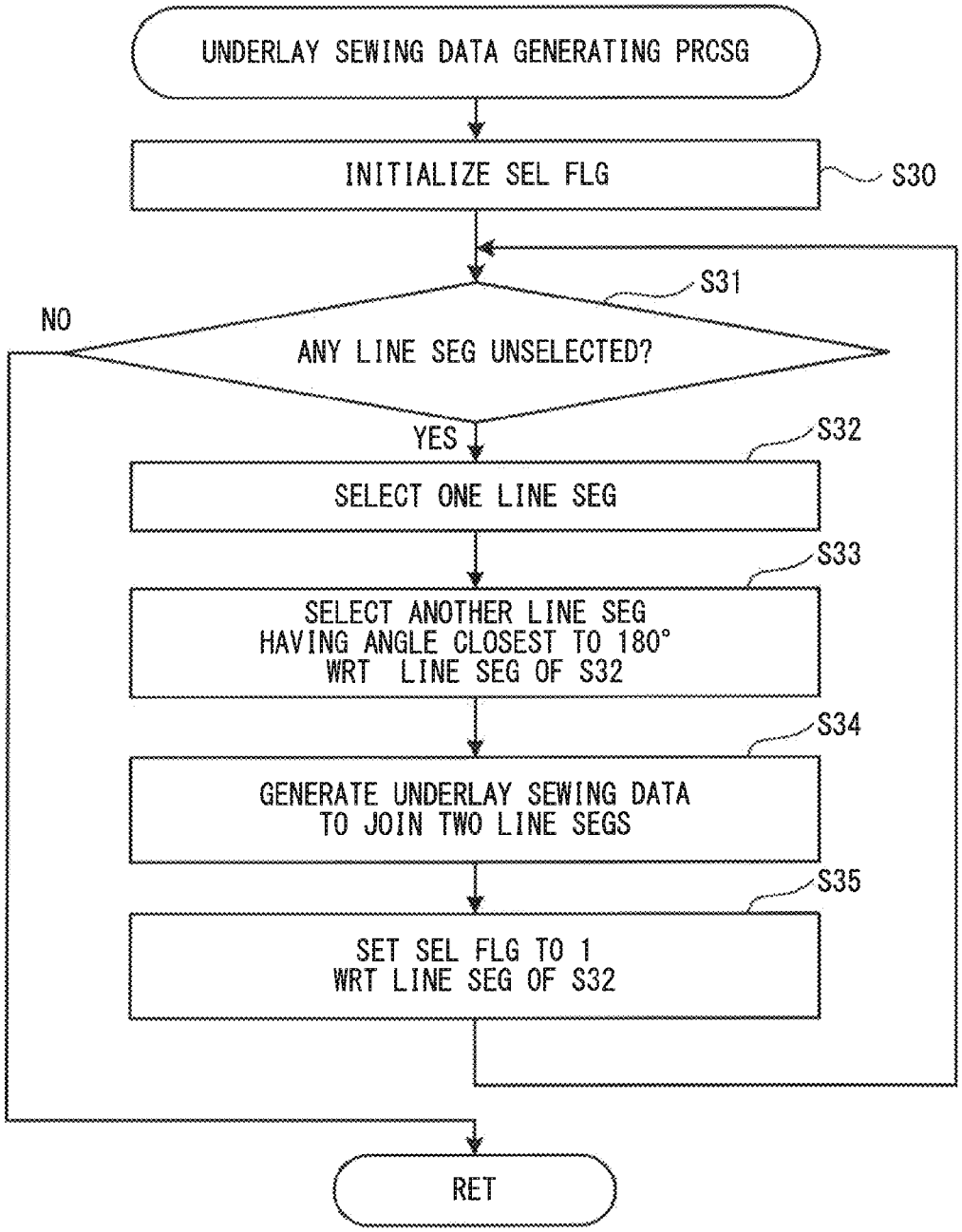
FIG. 14 is a flowchart of underlay sewing data generating processing.

The underlay sewing data generating processing will be explained with reference to FIG. 14 to FIG. 17. As shown in FIG. 14, first, the CPU 61 sets a plurality of selection flags in the RAM 63 that correspond to a number of the bridge line segments generated in the above-described bridge data generating processing. At the same time, the CPU 61 initializes each of the selection flags to 0 (step S30). To explain the above-described bridge data generating processing using a specific example, in the present specific example, eight of the selection flags are set and the eight selection flags correspond to the bridge line segments A1 to A8, respectively. Each of the selection flags stores one of "selected" or "not yet selected" as a target line segment. When the target line segment is not yet selected, 0 is stored for the selection flag, and when the target line segment has been selected, 1 is stored for the selection flag.

Figure 15:
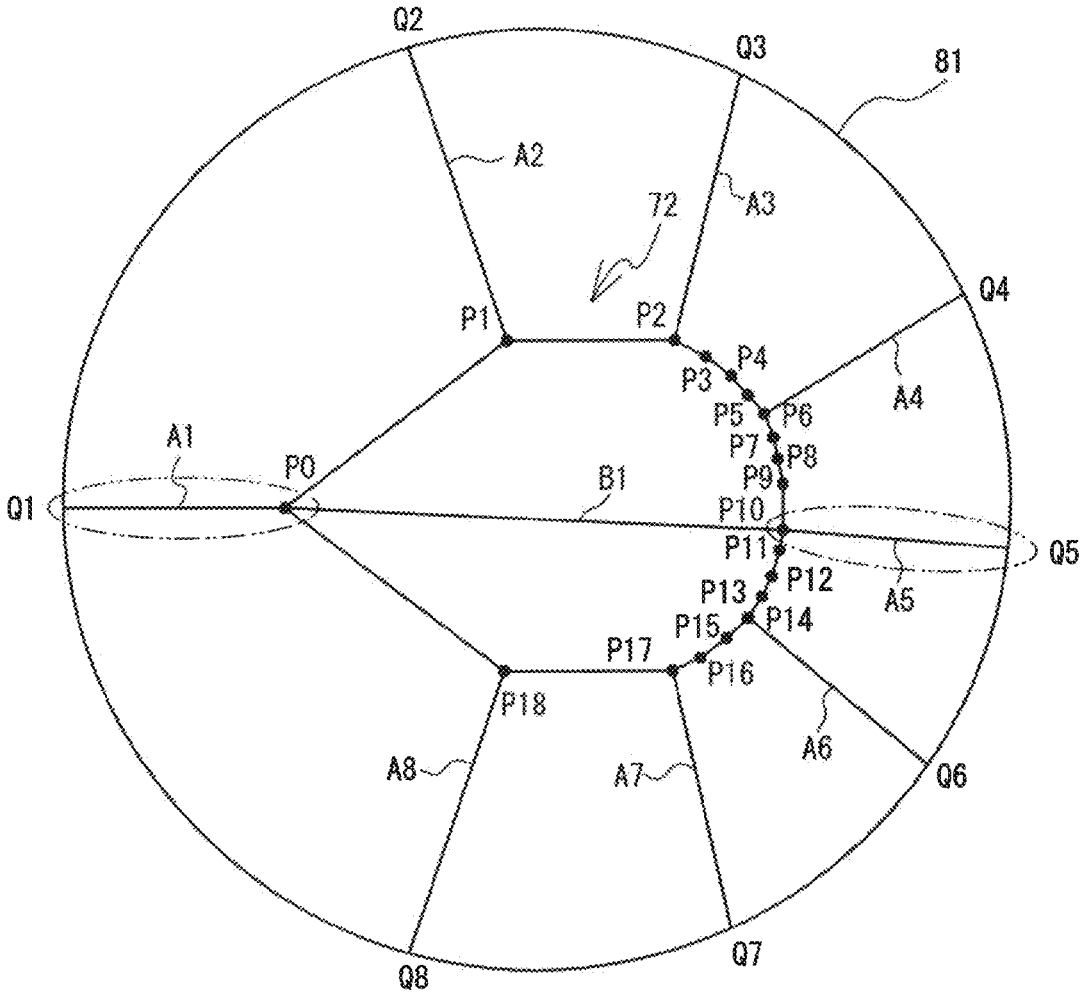
FIG. 15 is a diagram showing an arrangement of a line segment B1.
Figure 16:
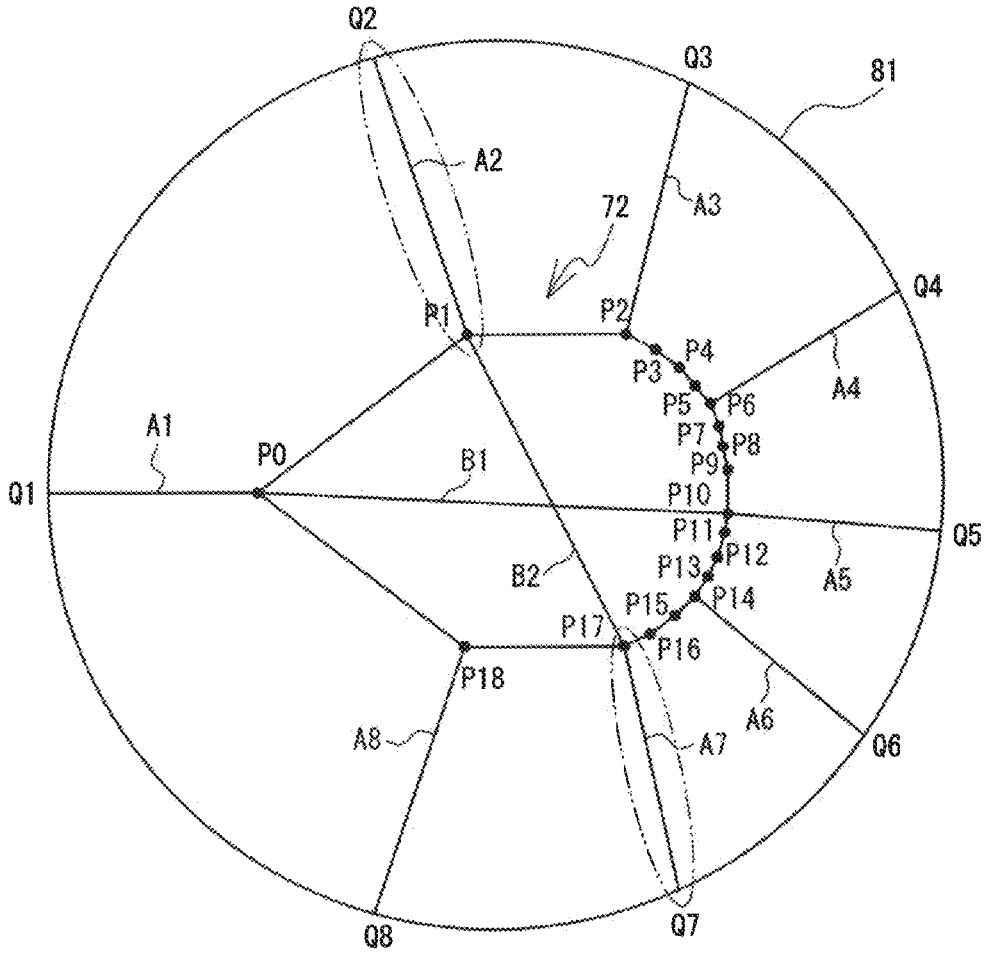
FIG. 16 is a diagram showing an arrangement of a line segment B2.

Next, the CPU 61 determines whether or not there is at least one bridge line segments not yet selected (step S31). When there is at least one selection flags for which 0 is stored among the plurality of (in the present embodiment, the eight) selection flags (YES at step S31), the CPU 61 selects one from among at least one bridge line segments for which the selection flag is 0 (step S32). At first, all the selection flags are 0. Thus, as shown in FIG. 15, for example, the CPU 61 first selects the bridge line segment A1 of the vertex P0 that has the smallest vertex number.

Next, the CPU 61 selects the bridge line segment that has an angle closest to 180 degrees with respect to the selected bridge line segment (step S33). Specifically, for example, the CPU 61 determines whether or not there is one other of the bridge line segments whose angle with respect to the selected bridge line segment (the line segment A1 in the present specific example) is within a predetermined range 180 degrees±γ degrees. When there is the one other of the bridge line segments within the predetermined range, the CPU 61 selects the one other bridge line segment (step S33). For example, when there is not the one other of the bridge line segments within the predetermined range, the CPU 61 may enlarge the predetermined range, namely γ, by a predetermined angle at a time, and, when the one other of the bridge line segments is positioned within the enlarged predetermined range, the CPU 61 may select that other bridge line segment. In the present specific example, the CPU 61 selects the bridge line segment A5 whose angle with respect to the selected line segment A1 is closest to 180 degrees (step S33).

Next, the CPU 61 generates the underlay sewing data, which corresponds to a line segment that joins the selected two bridge line segments (step S34). In the present specific example, as shown in FIG. 15, the CPU 61 generates a line segment B1 such that the vertex P0 and the vertex P10 are joined, and at the same time generates underlay sewing data that corresponds to the line segment B1. The vertex P0 is an end point of the line segment A1 on the contour line of the polygon 72. The vertex P10 is an end point of the line segment A5 on the contour line of the polygon 72. The underlay sewing data is coordinate data of two end points (the vertex P0 and the vertex P10) of the line segment B1. The CPU 61 stores the generated underlay sewing data of the line segment B1 in the RAM 63. The CPU 61 stores 1 for each of the selection flags corresponding to the selected bridge line segments A1 and A5 (step S35). The CPU 61 returns the processing to step S31.

In the present specific example, at this point, among the eight selection flags, 1 is stored for the two selection flags corresponding to the line segment A1 and the line segment A5, and 0 is stored for the selection flags corresponding to all the other line segments. As there are the bridge line segments that have not yet been selected (YES at step S31), the CPU 61 selects, from among the not yet selected line segments A2 to A4 and the line segments A6 to A8, the line segment A2 that has the smallest number (step S32). Note that an order in which the one line segment is selected from among the not yet selected line segments can be freely changed.

Next, the CPU 61 uses the above-described method to select the bridge line segment A7 whose angle with respect to the selected line segment A2 is closest to 180 degrees (step S33). The CPU 61 generates a line segment B2 such that the vertex P1 and the vertex P17 are joined, and generates underlay sewing data (step S34). The vertex P1 is an end point of the line segment A2 on the contour line of the polygon 72. The vertex P17 is an end point of the line segment A7 on the contour line of the polygon 72. The underlay sewing data is coordinate data of two end points (the vertex P1 and the vertex P17) of the line segment B2. The CPU 61 stores the generated underlay sewing data of the line segment B2 in the RAM 63. The CPU 61 stores 1 for each of the selection flags corresponding to the selected bridge line segments A2 and A7 (step S35). The CPU 61 returns the processing to step S31.

Figure 17:
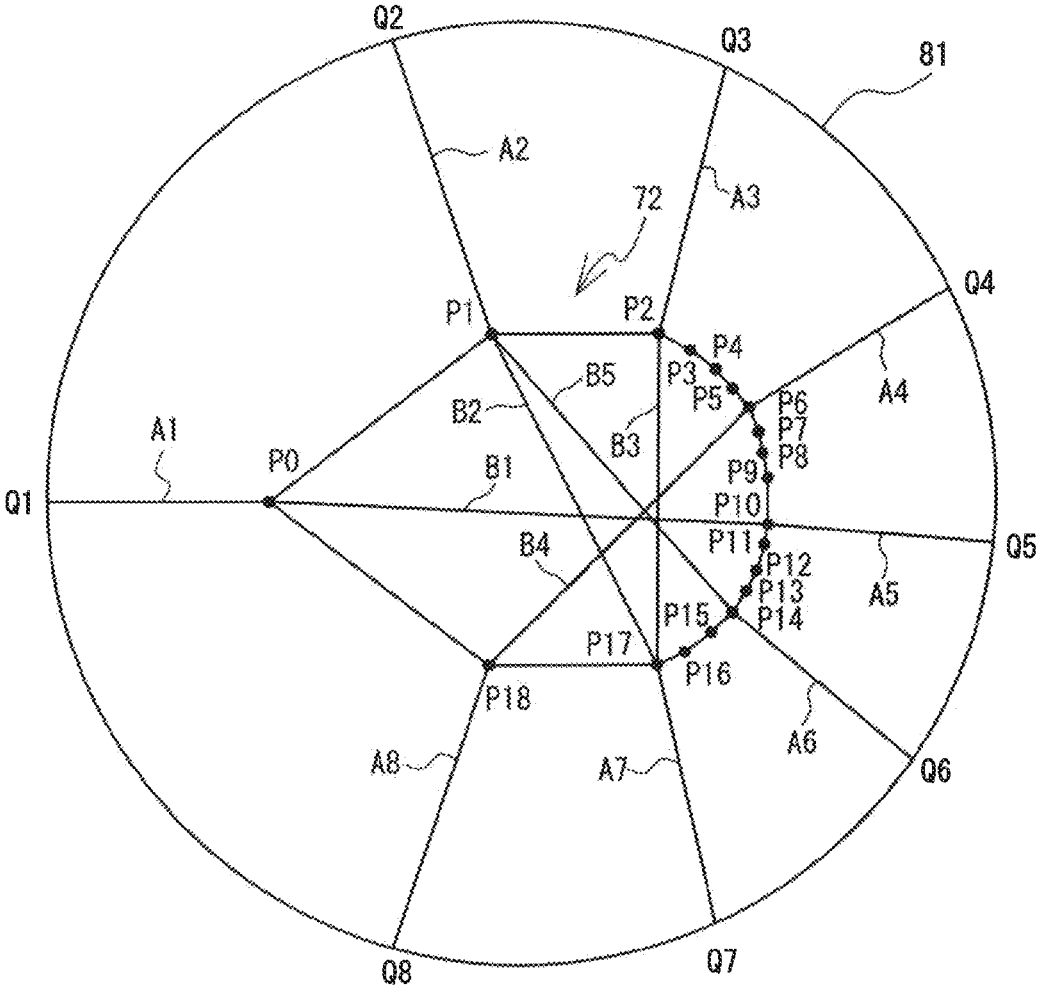
FIG. 17 is a diagram showing respective arrangements of the line segments B1 to B5.

Until all of the bridge line segments (the line segments A1 to A8 in the present specific example) have been selected, determination results at step S31 are YES, then the CPU 61 sequentially performs the above-described processing at step S32 to step S35. In the present specific example, when 1 is stored for each of the selection flags of the line segments A1 to A8, a state is obtained in which underlay line segments B1 to B5 have been generated on the inside of the polygon 72, as shown in FIG. 17. The line segment B3 is a line segment that joins the vertex P2 and the vertex P17. The line segment B4 is a line segment that joins the vertex P6 and the vertex P18. The line segment B5 is a line segment that joins the vertex P1 and the vertex P14. When all of the bridge line segments have been selected in this manner (NO at step S31), the CPU 61 ends the underlay sewing data generating processing and advances the processing to step S9 of the embroidery data generating processing shown in FIG. 5.

In this way, the underlay sewing data generating processing of the present embodiment joins, with an underlay sewing line segment, the end point of the bridge line segment whose angle with respect to the target line segment is closest to 180 degrees and the end point of the target line segment. In this manner, it is possible to make as straight as possible a line that joins the two bridge line segments and the underlay sewing line segment. Then, when the underlay sewing is performed by the sewing machine 1 in accordance with the underlay sewing data generated by the underlay sewing data generating processing in this manner, the underlay sewing and the bridges are joined together in a substantially straight line. In this case, due to puckering of the embroidery pattern 70, the bridge stitches are stretched. Thus, the bridge stitches do not become slack and the position of the embroidery pattern 70 with respect to the hole can be fixed. Further, an aesthetic appearance around the embroidery pattern 70 can also be improved.

A first modified example of the underlay sewing data generating processing will be explained with reference to FIG. 18 to FIG. 20. In the underlay sewing data generating processing shown in FIG. 14, in the processing at step S33, the CPU 61 selects the bridge line segment whose angle with respect to the selected line segment is closest to 180 degrees. In the first modified example, the CPU 61 selects the bridge line segment having the closest distance to an intersection point at which an extension line of the selected line segment intersects the polygon 72. In the underlay sewing data generating processing shown in FIG. 18, only the processing at step S133 is performed in place of the processing at step S33 of the underlay sewing data generating processing shown in FIG. 14, and all of the other processing is the same. Thus, the present modified example will be explained focusing on the processing at step S113.

Figure 18:
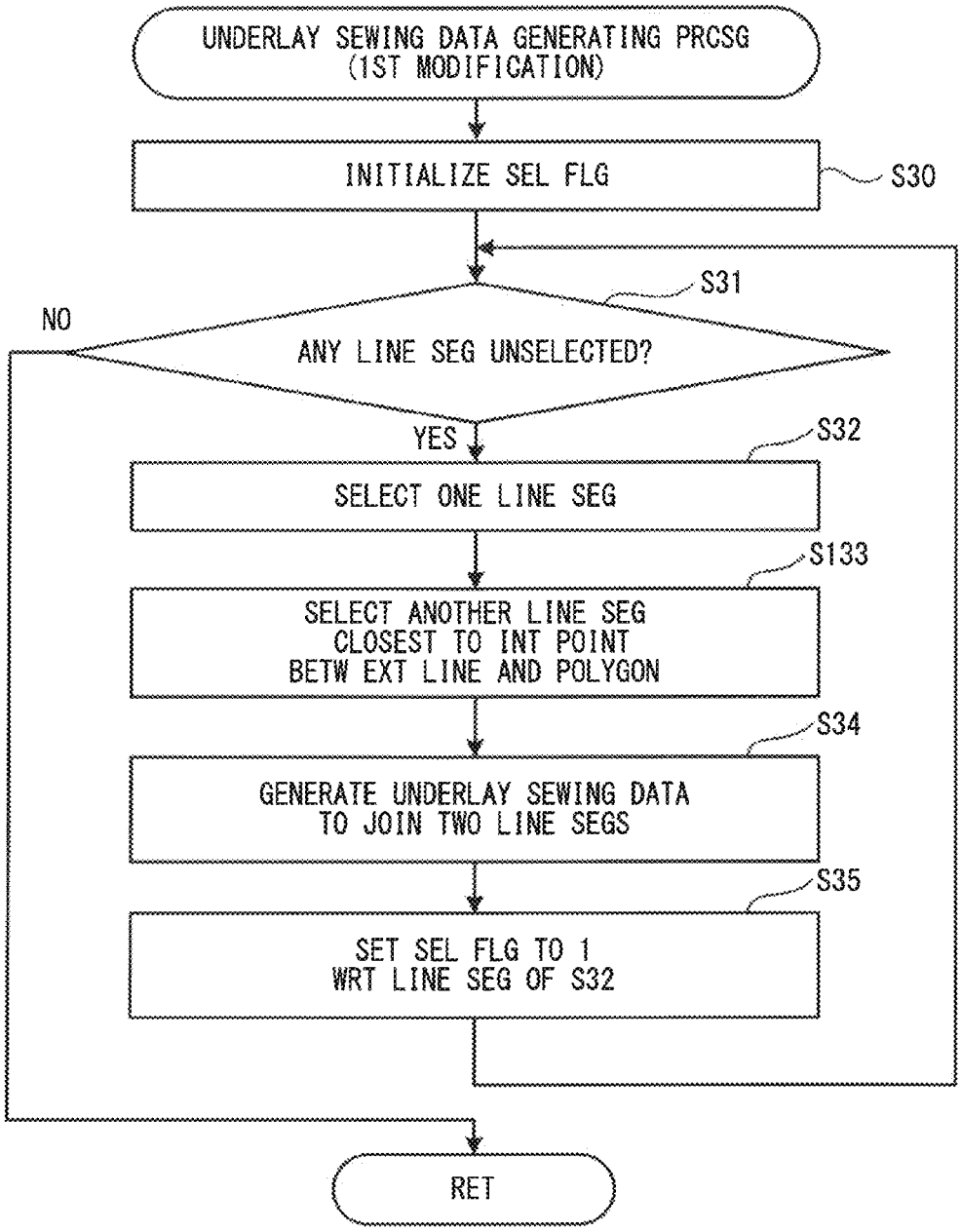
FIG. 18 is a flowchart of underlay sewing data generating processing (a first modified example)

As shown in FIG. 18, first the CPU 61 initializes all of the plurality of selection flags set in the RAM 63 (eight in the present specific example shown in FIGS. 19) to 0 (step S30). Further, the CPU 61 selects one of the not yet selected bridge line segments (step S31, step S32). As shown in FIG. 19, the CPU 61 selects, for example, the bridge line segment A1 of the vertex P0 that has the smallest vertex number. Next, the CPU 61 selects the bridge line segment having the closest distance to an intersection point at which the extension line of the selected line segment intersects the polygon 72 (step S133).

Figure 19:
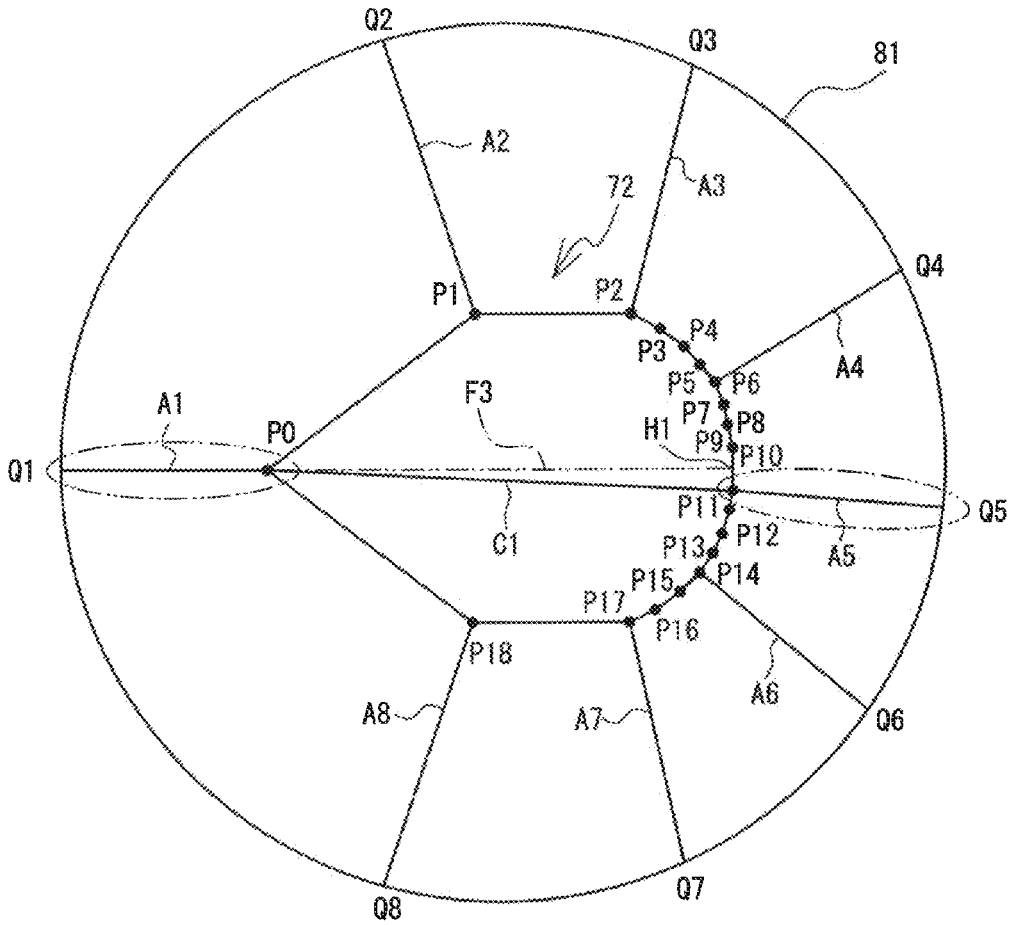
FIG. 19 is a diagram showing an arrangement of a line segment C1.
Figure 20:
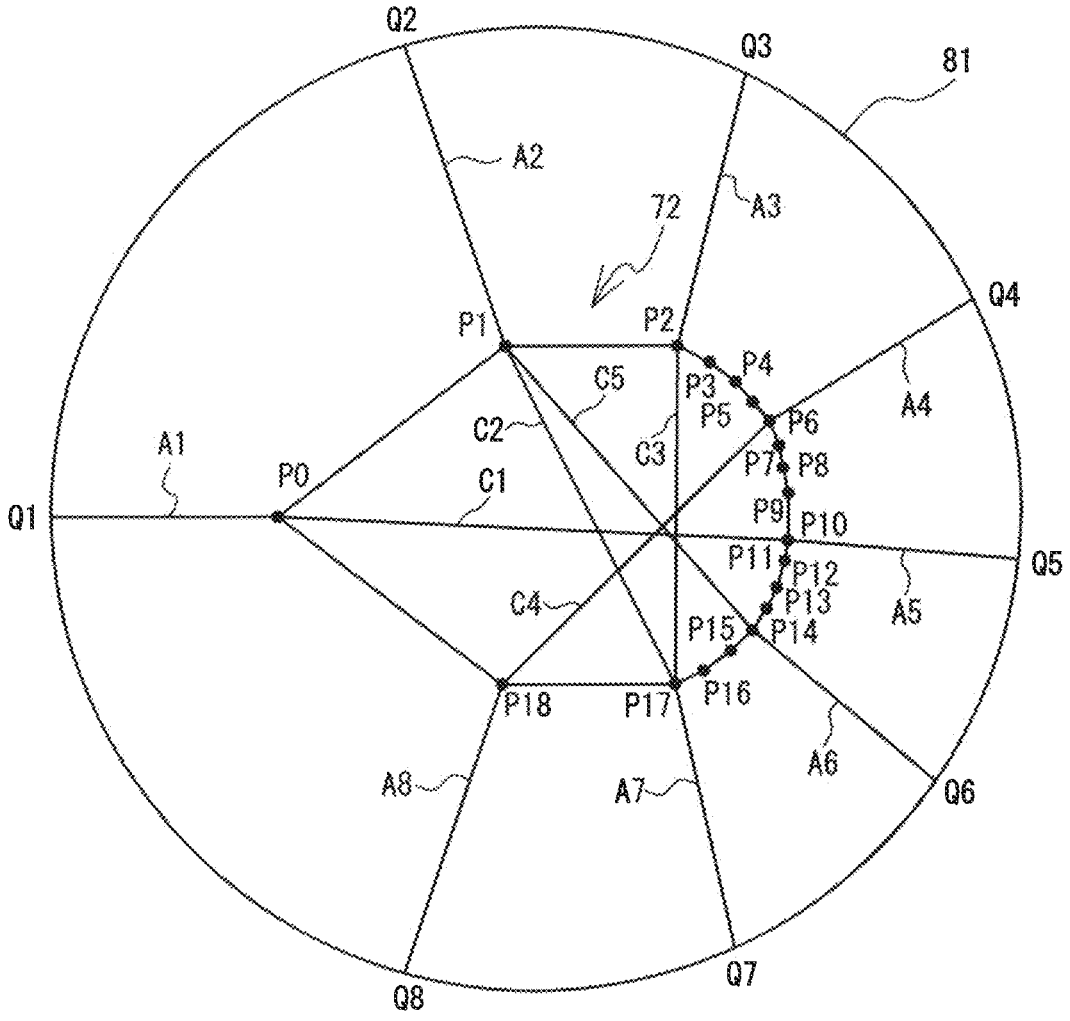
FIG. 20 is a diagram showing respective arrangements of the line segments C1 to C5.

As shown in FIG. 19, for example, the CPU 61 acquires a coordinate position of an intersection point H1, which is the point at which a virtual extension line F3 of the line segment A1 intersects the contour line of the polygon 72. The CPU 61 stores the coordinate position of the intersection point H1 in the RAM 63. The CPU 61 calculates respective distances between the coordinate position of the intersection point H1 and coordinate positions of the vertices P1, P2, P6, P10, P14, P17 and P18 corresponding to each of the bridge line segments A2 to A8. The vertex having the closest distance to the intersection point H1 is the vertex P10. The CPU 61 therefore selects the line segment A5 (step S133).

Next, the CPU 61 generates a line segment C1 such that the vertex P0 and the vertex P10 are joined, and generates underlay sewing data (step S34). The CPU 61 stores the generated underlay sewing data of the line segment C1 in the RAM 63. In the RAM 63, the CPU 61 stores 1 for each of the selection flags corresponding to the selected bridge line segments A1 and A5 (step S35). The CPU 61 returns the processing to step S31.

Until all of the bridge line segments (the line segments A1 to A8 in the present specific example) have been selected, determination results at step S31 are YES, then the CPU 61 then sequentially performs the above-described processing at step S32, step S133, step S34 and step S35. In the present specific example, when 1 is stored for each of the selection flags of the line segments A1 to A8 and all of the line segments A1 to A8 have been selected, a state is obtained in which underlay line segments C1 to C5 have been generated on the inside of the polygon 72, as shown in FIG. 20. An arrangement of the underlay sewing line segments C1 to C5 shown in FIG. 20 is the same as the arrangement of the underlay sewing line segments B1 to B5 shown in FIG. 17. When all of the bridge line segments have been selected in this manner (NO at step S31), the CPU 61 ends the underlay sewing data generating processing and advances the processing to step S9 of the embroidery data generating processing shown in FIG. 5.

In this way, the first modified example of the underlay sewing data generating processing joins the end point of the target line segment to the vertex that has the closest distance to the intersection point at which the virtual extension line of the target line segment intersects the contour line of the polygon 72. In this manner, it is possible to make as straight as possible a line that joins the two bridge line segments and the underlay sewing line segment. Then, when the underlay sewing is performed by the sewing machine 1 in accordance with the underlay sewing data generated in the first modified example in this manner, the underlay sewing and the bridges are joined together in a substantially straight line. Therefore, as described above, the bridge stitches do not become slack and the position of the embroidery pattern 70 with respect to the hole can be fixed. Further, the aesthetic appearance around the embroidery pattern 70 can also be improved.

Figure 22:
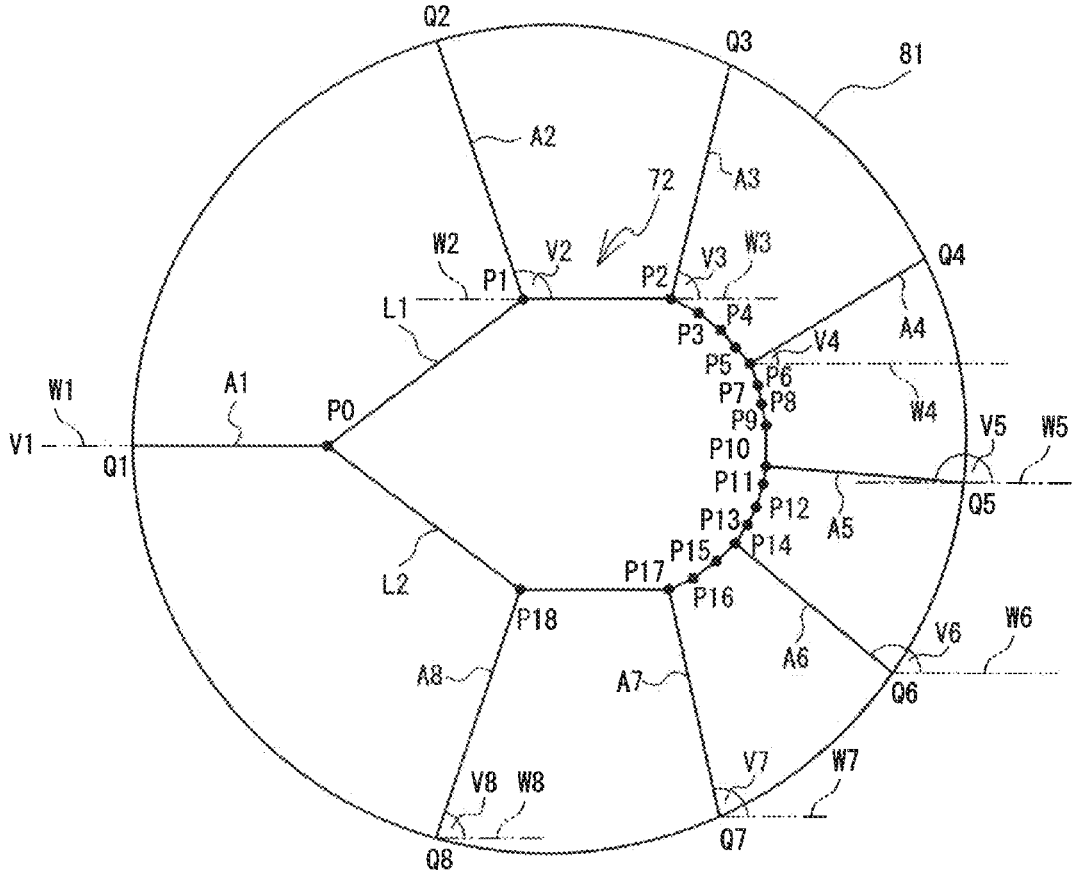
FIG. 22 is a diagram showing angles V1 to V8 with respect to horizontal reference lines W1 to W8 of each of the line segments A1 to A8.
Figure 23:
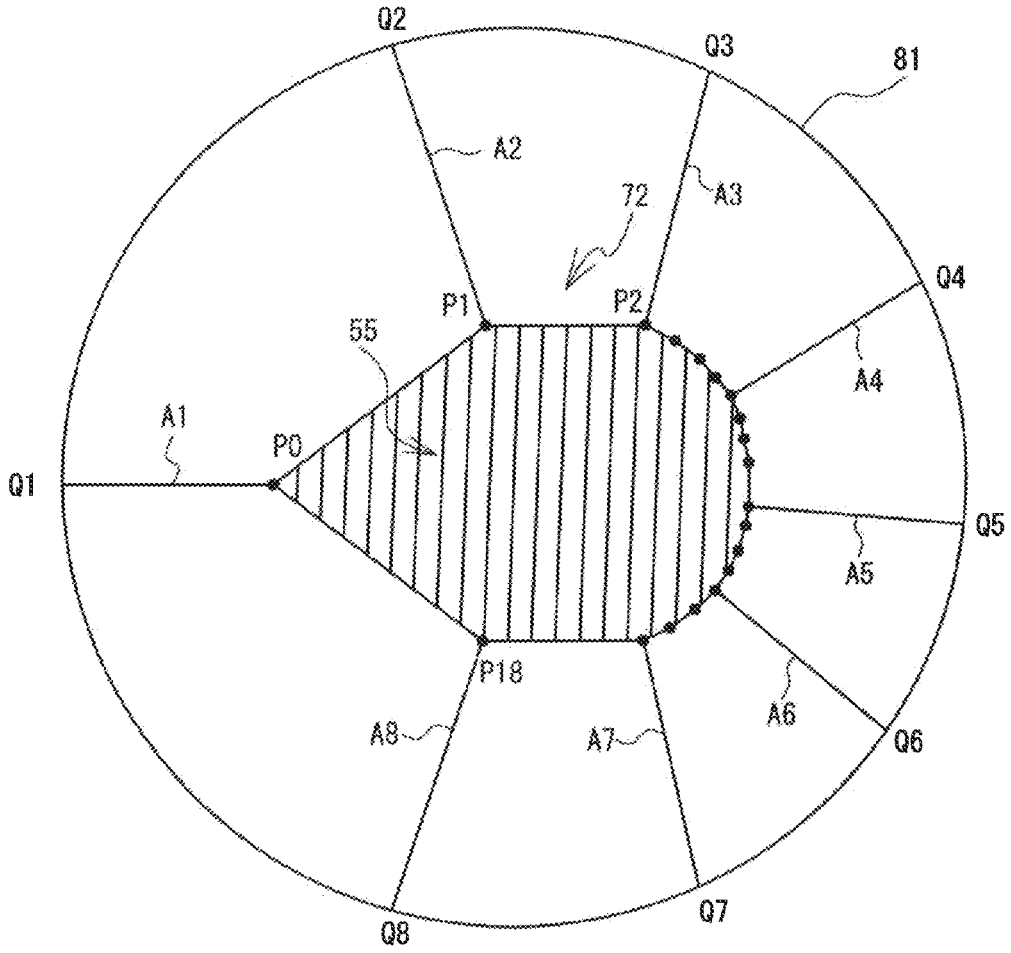
FIG. 23 is a diagram showing an arrangement of line segments 55 at an inclined angle α and a density β.

A second modified example of the underlay sewing data generating processing will be explained with reference to FIG. 21 to FIG. 23, using a specific example. In the second modified example, the CPU 61 calculates angles formed respectively between each of the bridge line segments A1 to A8 and horizontal reference lines that will be explained below. The CPU 61 then uses an average value of the calculated angles to determine an underlay sewing angle $\alpha$ ($\alpha$ is not shown in the drawings). The underlay sewing angle $\alpha$ is an angle in the embroidery coordinate system 100 shown in FIG. 3 (an angle formed with the X axis in FIG. 3) of each of a plurality of underlay sewing lines (refer to a reference numeral 55 in FIG. 23).

Figure 21:
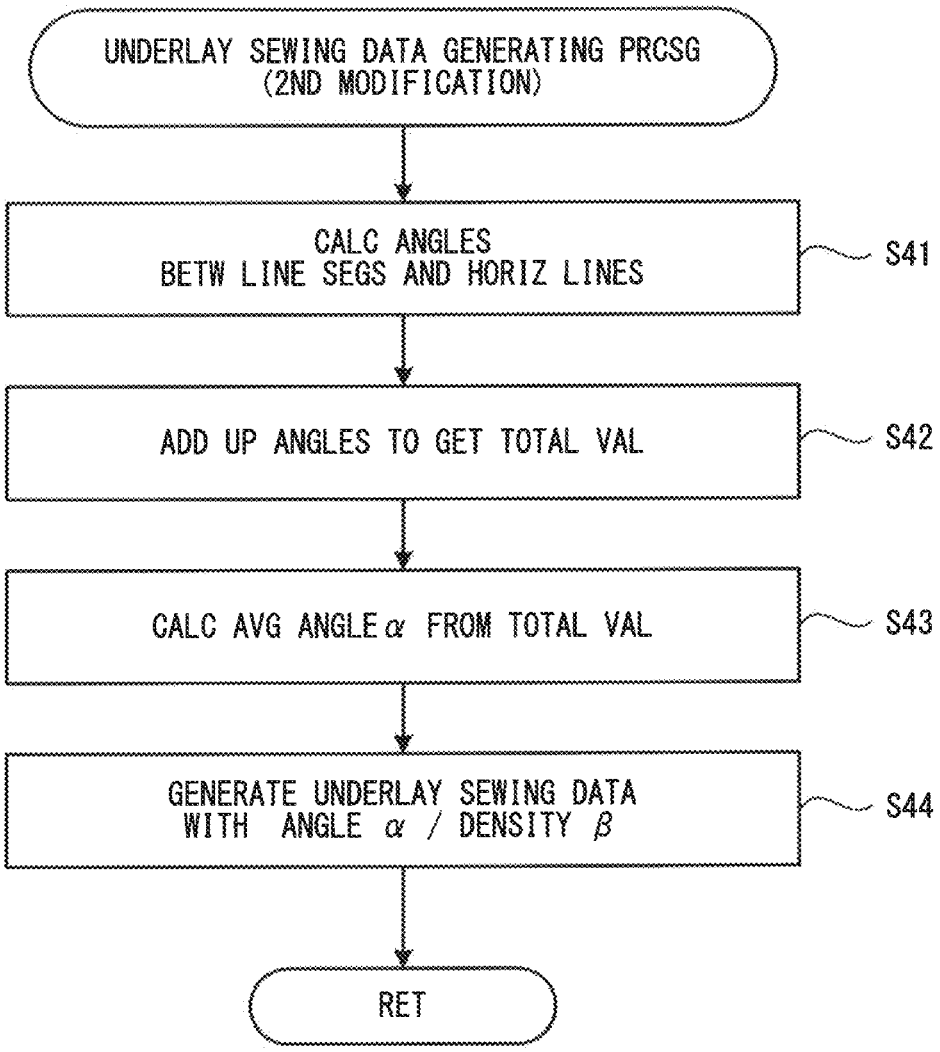
FIG. 21 is a flowchart of underlay sewing data generating processing (a second modified example)

As shown in FIG. 21, the CPU 61 respectively acquires angles (angles V1 to V8 in the present specific example) that are formed between horizontal reference lines (horizontal reference lines W1 to W8 in the present specific example) and each of the plurality of bridge line segments (the line segments A1 to A8 in the present specific example). The horizontal reference lines W1 to W8 are reference lines for which y=0 when a lowermost point of each of the bridge line segments A1 to A8 becomes the coordinates (0, 0). Note that, when the bridge line segment is horizontal (180 degrees) with respect to the horizontal reference line, the angle is 0 degrees. As shown in FIG. 22, the angle V1 is an angle formed at the vertex P0 between the bridge line segment A1 and the horizontal reference line W1. The angle V2 is an angle formed at the vertex P1 between the bridge line segment A2 and the horizontal reference line W2. The angle V3 is an angle formed at the vertex P2 between the bridge line segment A2 and the horizontal reference line W3. The angle V4 is an angle formed at the vertex P6 between the bridge line segment A4 and the horizontal reference line W4. The angle V5 is an angle formed at the vertex P10 between the bridge line segment A5 and the horizontal reference line W5. The angle V6 is an angle formed at the vertex P14 between the bridge line segment A6 and the horizontal reference line W6. The angle V7 is an angle formed at the vertex P17 between the bridge line segment A7 and the horizontal reference line W7. The angle V8 is an angle formed at the vertex P18 between the bridge line segment A8 and the horizontal reference line W8. Note that, for the purpose of illustration, the angle V5 to the angle V8 are shown on an intersection Q5 to an intersection Q8.

In the present specific example, the angle V1 is 0 degrees. The angle V2 is 108.54 degrees. The angle V3 is 76.03 degrees. The angle V4 is 30.93 degrees. The angle V5 is 175.23 degrees. The angle V6 is 140.31 degrees. The angle V7 is 102.63 degrees. The angle V8 is 71.57 degrees. The CPU 61 stores the calculated angles V1 to V8 in the RAM 63.

Next, the CPU 61 calculates a total value of the acquired plurality of angles (the angles V1 to V8 in the present specific example) (step S42), calculates an average value from that total value, and sets the calculated average value as the sewing angle $\alpha$ (step S43). Further, the CPU 61 generates the plurality of underlay sewing lines 55 at the calculated sewing angle $\alpha$, at a density of a fixed value $\beta$ inside the polygon 72, and generates underlay sewing data of each of the generated underlay sewing lines 55 (step S44). In the present specific example, the total value of the angles V1 to V8 is 705.24. The number of the bridge line segments A1 to A8 is eight. When 705.24 is divided by 8, the average value ≈88 degrees. Here, as shown in FIG. 23, the CPU 61 generates the plurality of underlay sewing lines 55 for which the sewing angle $\alpha$=88 degrees, at the density of the fixed value $\beta$ inside the polygon 72, and generates the underlay sewing data for the plurality of line segments 55 (step S44). The CPU 61 stores the generated underlay sewing data in the RAM 63. Note that it is assumed that the fixed value $\beta$ is stored in advance in the ROM 62 or the flash ROM 64. It should also be noted that the fixed value $\beta$ can be freely set and changed by the user. The CPU 61 ends the underlay sewing data generating processing and advances the processing to step S9 of the embroidery data generating processing shown in FIG. 5.

When the underlay sewing is performed by the sewing machine 1 in this way, in accordance with the underlay sewing data generated in the second modified example of the underlay sewing data generating processing, the underlay sewing angle is the average value of the angles formed between each of the plurality of bridge line segments and the horizontal reference lines. In this way, the sewing machine 1 can join the underlay sewing and the plurality of bridges in a well-balanced manner. As a result, it is possible to favorably maintain the shape of the embroidery pattern 70 that is sewn over this type of underlay sewing.

When the CPU 61 has ended the underlay sewing data generating processing, the CPU 61 returns the processing to the embroidery data generating processing shown in FIG. 5 and generates the embroidery data (step S9). This embroidery data is generated such that the underlay sewing (such as satin stitch sewing, for example) is first sewn by the sewing machine 1 based on the underlay sewing data generated in the underlay sewing data generating processing (step S8), then, after that, the embroidery pattern 70 is sewn over the underlay sewing based on the embroidery data, and finally, the plurality of bridges are sewn based on the bridge data generated in the bridge data generating processing (step S7). In this way, the CPU 61 ends the embroidery data generating processing.

As described above, the sewing machine 1 according to the present embodiment can generate the bridge data. The bridge data is data of line segments that join the peripheral edge portion of the hole formed in the sewing workpiece 39 with corner portions of the embroidery pattern 70 that is arranged on the inside of the hole. The CPU 61 of the sewing machine 1 acquires the cutting data and the embroidery data. The cutting data is the control data to form the hole in the sewing workpiece 39. The embroidery data is the control data to sew the embroidery pattern 70 using the sewing machine 1. Based on the acquired embroidery data, the CPU 61 calculates the minimum polygon 72 that encompasses the contour 71 of the embroidery pattern 70. The CPU 61 expands the polygon 72 and the circle 81, which is shape data of the hole 80 included in the cutting data, into the RAM 63 such that the polygon 72 overlaps with the circle 81. The CPU 61 generates bridge line segments, respectively, for at least three of the vertices P0 to P18 of the polygon 72. The bridge line segments are line segments that join the vertices of the polygon to the peripheral edge portion of the circle 81. The CPU 61 generates the bridge data based on the line segments A1 to A8. The sewing machine 1 sews the bridges around the embroidery pattern 70 based on the generated bridge data. Due to a tension of a thread of the bridges, the corner portions of the embroidery pattern 70 do not bend. It is therefore possible to maintain the shape of the embroidery pattern 70. The bridge is sewn from the corner portion of the embroidery pattern 70 toward the peripheral edge portion of the hole. Thus, the sewing machine 1 can accentuate the inherent design of embroidery pattern 70.

Figure 24:
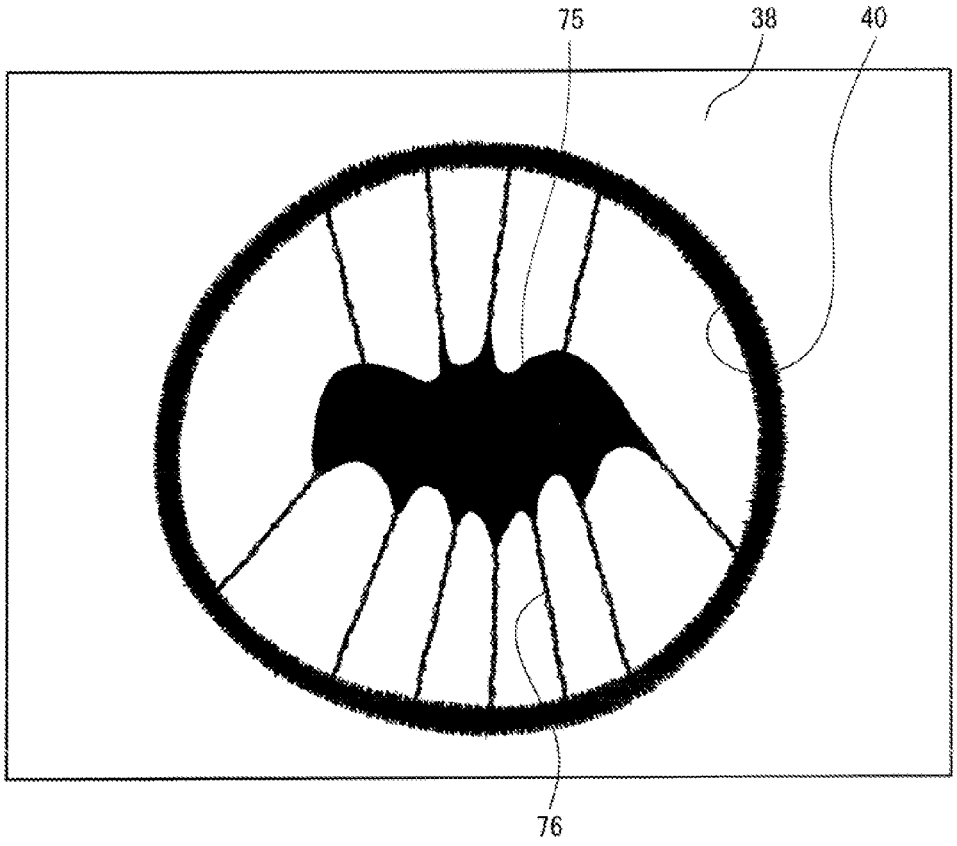
FIG. 24 is a photograph showing an example of a result of performing sewing.

FIG. 24 is a photograph showing an example of a result of performing the cutting and sewing on a fabric 38 by the sewing machine 1, based on the embroidery data generated by the embroidery data generating processing shown in FIG. 5. In this example, a bat-shaped embroidery pattern 75 is arranged at the center of a circular hole 40 formed in the fabric 38. Further, 11 bridges 76 are formed between 11 corner portions of the embroidery pattern 75 and a peripheral edge portion of the hole 40. Note that the embroidery pattern 75 and the bridges 76 are arranged on the inside of the hole 40 by performing sewing on a water-soluble sheet that is adhered to the fabric 38, after the hole 40 is formed by the cutting needles 52. By dissolving the water-soluble sheet using a water or a solvent etc. after the sewing of the embroidery pattern 75 and the bridges 76, the embroidery pattern 75 is held at the center of the hole 40 by the 11 bridges 76. The bridges 76 are formed by run stitches. As shown in FIG. 24, the 11 corner portions of the embroidery pattern 75 do not bend, due to the tension of the thread of the 11 bridges 76. Thus, the embroidery pattern 75 can beautifully maintain its bat shape on the inside of the hole 40, without bending. Further, on the inside of the hole 40, nothing is present around the embroidery pattern 75 except for the 11 bridges 76. As a result, the sewing machine 1 can accentuate the design of the embroidery pattern 75 on the inside of the hole 40. It should be noted that the peripheral edge portion of the hole 40 shown in FIG. 24 is finished using overcasting, as in related art.

In addition, in the above-described embodiment, for the determination as to whether or not to generate the bridge line segment for each of the vertices of the polygon 72 (the vertices P0 to P18 in the above-described specific example), the bridge line segment is generated when the angle formed by the two adjacent sides forming the vertex is equal to or less than a threshold value (150 degrees, for example). The smaller the angle formed between two adjacent sides of the polygon 72, the more the vertex formed by those two sides is a protruding portion. Therefore, by generating the line segment that equally bisects the vertex, the sewing machine 1 can join at least the protruding corner portion of the embroidery pattern 70 to the peripheral edge portion around the hole. In this way, the sewing machine 1 can inhibit the corner portions of the embroidery pattern 70 from bending in the sewing workpiece 39. Further, as the sewing machine 1 generates the line segment that equally bisects the angle formed by the two adjacent sides, the sewing machine 1 can form the bridges with respect to the peripheral edge portion around the hole, in a state in which the corner portions of the embroidery pattern 70 are stable and well-balanced.

Note that, in the above-described embodiment, for the determination as to whether or not to generate the bridge line segment for each of the vertices of the polygon 72 (the vertices P0 to P18 in the above-described specific example), the bridge line segment may be generated when the sum of the lengths of the two adjacent sides of the polygon 72 are equal to or greater than the threshold value. The larger the sum of the lengths of the two adjacent sides of the polygon 72, the more the vertex formed by those two sides is a protruding portion. The sewing machine 1 generates the line segment that equally bisects the angle formed by the two adjacent sides when the sum of the lengths of the two adjacent sides is equal to or greater than the threshold value. In that way, the sewing machine 1 can join at least the protruding corner portion of the embroidery pattern 70 to the peripheral edge portion around the hole. Therefore, the sewing machine 1 can form the bridges between the peripheral edge portion of the hole and the corner portions of the embroidery pattern 70 that are easily bent.

In addition, in the above-described embodiment, it is possible to form the at least three bridge line segments for the minimum polygon that encompasses the embroidery pattern 70. As a result, when the sewing is performed in accordance with the embroidery data generated in the above-described embodiment, it is possible to hold the embroidery pattern 70 in a stable state on the inside of the hole formed in the sewing workpiece 39.

The present disclosure is not limited to the above-described embodiment, specific examples and various modified examples, and various modifications to the above are possible. For example, in the above-described embodiment, the hole 80 that is formed in the sewing workpiece 39 can be cut by the cutting needle 52 (refer to FIG. 2) of the sewing machine 1. Therefore, the CPU 61 reads out the shape data of the hole 80 that is to be formed in the sewing workpiece 39 from the cutting data of the hole 80, during the embroidery data generating processing shown in FIG. 5. In contrast to this, when the sewing machine 1 is provided with a known applique generating function, for example, the CPU 61 may use run stitch data to execute run stitches along a contour of an applique piece, instead of the cutting data. The run stitch data is data of needle drop points of the sewing needle 51 that is used to sew a cut-out line of an applique piece in fabric by the sewing machine 1, using run stitches, when an applique piece is formed using a fabric.

Figure 25:
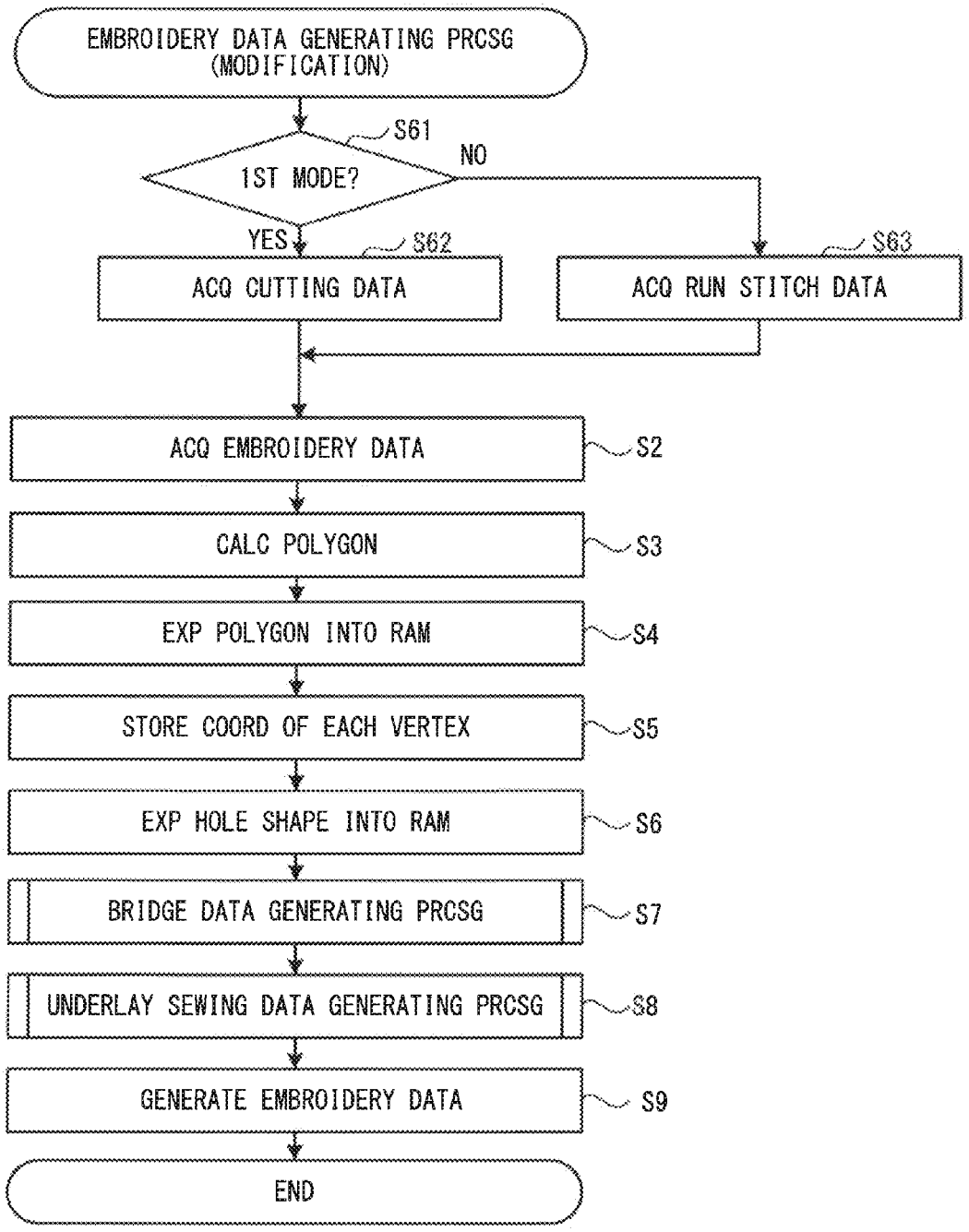
FIG. 25 is a flowchart of embroidery data generating processing (a modified example).

A modified example of the embroidery data generating processing will be explained with reference to FIG. 25. Note that, in processing of the present modified example, step S61 to step S63 are performed in place of performing the processing at step S1 of the embroidery data generating processing shown in FIG. 5. Otherwise all of the processing is the same as that of the embroidery data generating processing shown in FIG. 5. Thus, the present modified example will be explained focusing on the first processing at step S61 to step S63. A command to start the present processing is input, for example, by a panel operation by the user, similarly to the above-described embodiment. When the start command is input, the CPU 61 reads out the embroidery data generating program from the ROM 62 (refer to FIG. 4) and performs the present processing.

First, by a panel operation by the user, the hole shape to be formed in the sewing workpiece 39 is selected. Next, by a panel operation by the user, one of a first mode and a second mode is selected, as the cutting method of the hole to be formed in the sewing workpiece 39. The first mode is a mode in which the cutting needle 52 of the sewing machine 1 cuts the hole. The second mode is a mode in which the applique generating function is used and stitches are generated along a contour of the hole to be formed in the sewing workpiece 39. The user then uses scissors or the like to cut along the stitches and form the hole.

The CPU 61 determines whether or not the first mode has been selected, based on the panel operation by the user (step S61). When the first mode has been selected (YES at step S61), the CPU 61 acquires, from the flash ROM 64, cutting data corresponding to the hole 80 (refer to FIG. 6) selected by the panel operation (step S62). When the second mode has been selected (NO at step S61), the CPU 61 acquires, from the flash ROM 64, run stitch data corresponding to the hole 80 selected by the panel operation (step S62). The CPU 61 stores the acquired cutting data or run stitch data in the RAM 63. The CPU 61 can identify the shape of the hole 80 based on the cutting data or the run stitch data stored in the RAM 63. After that, the CPU 61 performs the processing from step S2 onward that is the same as the embroidery data generating processing shown in FIG. 5, and can generate the embroidery data similarly to the above-described embodiment.

In addition to the above-described embodiment and various modified examples, further various modifications can be made to the present disclosure. For example, in the above-described embodiment, the sewing machine 1 that is provided with the ten needle bars is exemplified, but a target of application of the present disclosure is not limited to that example. In other words, the target of application of the present disclosure may be, for example, a multi-needle sewing machine that is provided with a plurality of needle bars (six, for example).

Further, the target of application of the present disclosure is not limited to the multi-needle sewing machine 1 that is provided with a plurality of needle bars, such as that described above. For example, a sewing machine that is provided with an applique function, and that is provided with a single needle bar may also be a target of application of the present disclosure.

In addition, the sewing machine 1 of the above-described embodiment sews the bridges using run stitches between the embroidery pattern 70 and the peripheral edge portion of the hole, based on the generated bridge data. However, the stitches of the bridges may be another type of stitch.

Further, in the above-described embodiment, the underlay sewing data generating processing may be omitted. The underlay sewing need not necessarily be sewn before the embroidery pattern 70 is sewn on the water-soluble sheet. Further, in the above-described embodiment, the underlay sewing is performed using satin stitches, but another type of stitch may be used, such as run stitches, for example.

In addition, in the above-described embodiment, the hole shape to be formed in the sewing workpiece 39 can be selected by the panel operation, but, for example, the sewing machine 1 may automatically generate the hole shape to match a shape of the embroidery pattern.

Further, in place of the underlay sewing, or in addition to the underlay sewing, reinforcement may be made such that the shape of the embroidery pattern does not become distorted, by forming stitches along the periphery of the embroidery pattern 70.

Further, in the above-described embodiment, the bridge is sewn from the corner portion of the embroidery pattern toward the peripheral edge portion of the hole, but the bridge may be sewn toward the peripheral edge portion of the hole from a side of the embroidery pattern other than the corner portion.

In addition, in the above-described embodiment, the CPU 61 generates the bridge data based on the cutting data of the hole and the embroidery data of the embroidery pattern 70 stored in the ROM 62 or the flash ROM 64. In contrast to this, for example, the bridge data may be generated by an external device. The external device may be, for example, a known personal computer (PC). The sewing machine 1 may acquire the bridge data generated by the external device. For example, the PC may store the generated bridge data on a memory card. The sewing machine 1 may be provided with a card slot that is not shown in the drawings, and when the memory card storing the bridge data is inserted into the card slot, the sewing machine 1 may acquire the bridge data by reading out the bridge data stored on the memory card. The sewing machine 1 may form the plurality of bridges around the embroidery pattern 70 on a water-soluble sheet, by driving the embroidery frame movement mechanism 11 and the needle bar drive mechanism 32 based on the acquired bridge data. In this case, the external device corresponds to an "embroidery data generating device" of the present disclosure.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery data generating device comprising:

a hole data acquisition portion that acquires hole data to form a hole in a sewing workpiece;

an embroidery data acquisition portion that acquires embroidery data corresponding to an embroidery pattern to be arranged on the inside of the hole;

a polygon acquisition portion that, based on the acquired embroidery data, acquires a minimum polygon that encompasses the embroidery pattern;

a line segment generating portion that generates a line segment that joins the polygon and a peripheral edge portion of the hole, the line segment generating portion generating a plurality of line segments that join the polygon and the peripheral edge portion of the hole by generating the line segment for each of a plurality of different points on the polygon; and a bridge data generating portion that, based on the generated line segments, generates bridge data to form bridge stitches between the embroidery pattern and the peripheral edge portion of the hole.

2. The embroidery data generating device according to claim 1, wherein when an angle formed between two adjacent sides of the polygon is equal to or less than a threshold value, the line segment generating portion generates a line segment that passes through a vertex between the two adjacent sides of the polygon such that the generated line segment bisects the angle formed by the two adjacent sides.

3. The embroidery data generating device according to claim 1, wherein when a sum of lengths of two adjacent sides of the polygon is equal to or greater than a threshold value, the line segment generating portion generates a line segment that passes through a vertex between the two adjacent sides of the polygon such that the generated line segment bisects an angle formed by the two adjacent sides.

4. The embroidery data generating device according to claim 1, wherein the line segment generating portion generates at least three of the line segments.

5. The embroidery data generating device according to claim 1, further comprising:

an underlay sewing data generating portion that generates underlay sewing data based on the line segments, the underlay sewing data being data to perform underlay sewing, the underlay sewing being performed before sewing of the embroidery pattern, and stitches of the underlay sewing being covered by the sewing of the embroidery pattern.

6. The embroidery data generating device according to claim 5, further comprising:

an identification portion that identifies a specific line segment, the specific line segment being a line segment for which an angle formed between the specific line segment and a target line segment is closest to 180 degrees, the target line segment being one of the plurality of line segments, and the specific line segment being another of the plurality of line segments;

wherein the underlay sewing data generating portion generates the underlay sewing data such that the stitches of the underlay sewing are formed in a direction to join an end point on the embroidery pattern side of the target line segment with an end point on the embroidery pattern side of the specific line segment.

7. The embroidery data generating device according to claim 5, further comprising:

an identification portion that identifies a vertex of the polygon, the vertex having the closest distance to an intersection point between an extension line of a target line segment and the polygon, the target line segment being one of the plurality of line segments;

wherein the underlay sewing data generating portion generates the underlay sewing data such that the stitches of the underlay sewing are formed in a direction to join an end point on the embroidery pattern side of the target line segment with the vertex identified by the identification portion.

8. The embroidery data generating device according to claim 5, further comprising:

an average angle acquiring portion that acquires angles formed between each of the plurality of line segments and a specific reference line, and also acquires an average angle that is an average of all of the acquired angles;

wherein the underlay sewing data generating portion generates the underlay sewing data such that the stitches of the underlay sewing are formed in a direction in which the angle formed with the reference line becomes the average angle.

9. The embroidery data generating device according to claim 1, wherein, the hole data acquisition portion acquires, as the hole data, one of cutting data that is data to form the hole using a sewing machine on which is mounted a cutting needle that is provided with a blade on a leading end thereof, and stitch data that is data to form stitches indicating a cutting line that is used by a user to manually form the hole in the sewing workpiece.

10. A non-transitory computer-readable medium storing computer-readable instructions that, when executed by a processor of an embroidery data generating device, cause the embroidery data generating device to perform processes comprising:

acquiring hole data to form a hole in a sewing workpiece;

acquiring embroidery data corresponding to an embroidery pattern to be arranged on the inside of the hole;

acquiring, based on the acquired embroidery data, a minimum polygon that encompasses the embroidery pattern;

generating a plurality of line segments that join the polygon and a peripheral edge portion of the hole by generating a line segment that joins the polygon and the peripheral edge portion of the hole for each of a plurality of different points on the polygon; and generating, based on the generated line segments, bridge data to form bridge stitches between the embroidery pattern and the peripheral edge portion of the hole.

11. The non-transitory computer-readable medium according to claim 10, wherein, when an angle formed between two adjacent sides of the polygon is equal to or less than a threshold value, the process to generate the line segment generates a line segment that passes through a vertex between the two adjacent sides of the polygon such that the generated line segment bisects the angle formed by the two adjacent sides.

12. The non-transitory computer-readable medium according to claim 10, wherein, when a sum of lengths of two adjacent sides of the polygon is equal to or greater than a threshold value, the process to generate the line segment generates a line segment that passes through a vertex between the two adjacent sides of the polygon such that the generated line segment bisects an angle formed by the two adjacent sides.

13. The non-transitory computer-readable medium according to claim 10, wherein, the process to generate the line segment generates at least three of the line segments.

14. The non-transitory computer-readable medium according to claim 10, wherein the computer-readable instructions cause the embroidery data generating device to perform the processes further comprising:

generating underlay sewing data based on the line segments, the underlay sewing data being data to perform underlay sewing, the underlay sewing being performed before sewing of the embroidery pattern, and stitches of the underlay sewing being covered by the sewing of the embroidery pattern.

15. The non-transitory computer-readable medium according to claim 14, wherein the computer-readable instructions cause the embroidery data generating device to perform the processes further comprising:

identifying a specific line segment, the specific line segment being a line segment for which an angle formed between the specific line segment and a target line segment is closest to 180 degrees, the target line segment being one of the plurality of line segments, and the specific line segment being another of the plurality of line segments;

wherein the process to generate the underlay sewing data generates the underlay sewing data such that the stitches of the underlay sewing are formed in a direction to join an end point on the embroidery pattern side of the target line segment with an end point on the embroidery pattern side of the specific line segment.

16. The non-transitory computer-readable medium according to claim 14, wherein the computer-readable instructions cause the embroidery data generating device to perform the processes further comprising:

identifying a vertex of the polygon, the vertex having the closest distance to an intersection point between an extension line of a target line segment and the polygon, the target line segment being one of the plurality of line segments;

wherein the process to generate the underlay sewing data generates the underlay sewing data such that the stitches of the underlay sewing are formed in a direction to join an end point on the embroidery pattern side of the target line segment with the vertex identified by the identification portion.

17. The non-transitory computer-readable medium according to claim 14, wherein the computer-readable instructions cause the embroidery data generating device to perform the processes further comprising:

acquiring angles formed between each of the plurality of line segments and a specific reference line, and also acquiring an average angle that is an average of all of the acquired angles;

wherein the process to generate the underlay sewing data generates the underlay sewing data such that the stitches of the underlay sewing are formed in a direction in which the angle formed with the reference line becomes the average angle.

18. The non-transitory computer-readable medium according to claim 10, wherein, the process to acquire the hole data acquires, as the hole data, one of cutting data that is data to form the hole using a sewing machine on which is mounted a cutting needle that is provided with a blade on a leading end thereof, and stitch data that is data to form stitches indicating a cutting line that is used by a user to manually form the hole in the sewing workpiece.

* * * * *